US011203927B2

(12) United States Patent
Kinn et al.

(10) Patent No.: US 11,203,927 B2
(45) Date of Patent: Dec. 21, 2021

(54) METHOD AND SYSTEM FOR PERFORMING WIRELESS ULTRASONIC COMMUNICATIONS ALONG TUBULAR MEMBERS

(71) Applicants: Timothy F. Kinn, Spring, TX (US); Xiaohua Yi, Houston, TX (US); Scott William Clawson, Califon, NJ (US); Mark M. Disko, Glen Gardner, NJ (US); Kenneth W. Desmond, Nazareth, PA (US); Jeff H. Moss, The Woodlands, TX (US)

(72) Inventors: Timothy F. Kinn, Spring, TX (US); Xiaohua Yi, Houston, TX (US); Scott William Clawson, Califon, NJ (US); Mark M. Disko, Glen Gardner, NJ (US); Kenneth W. Desmond, Nazareth, PA (US); Jeff H. Moss, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/175,467

(22) Filed: Oct. 30, 2018

(65) Prior Publication Data

US 2019/0153858 A1 May 23, 2019

Related U.S. Application Data

(60) Provisional application No. 62/588,080, filed on Nov. 17, 2017.

(51) Int. Cl.

| | |
|---|---|
| ***E21B 47/16*** | (2006.01) |
| ***E21B 47/14*** | (2006.01) |
| *E21B 47/13* | (2012.01) |

(52) U.S. Cl.
CPC ..... *E21B 47/16* (2013.01); *E21B 47/14* (2013.01); *E21B 47/13* (2020.05)

(58) Field of Classification Search
CPC ..... E21B 47/122; E21B 47/14; E21B 47/16
(Continued)

(56) References Cited

U.S. PATENT DOCUMENTS

| | | | | |
|---|---|---|---|---|
| 3,103,643 A | 9/1963 | Kalbfell | ..... | 340/17 |
| 3,205,477 A | 9/1965 | Kalbfell | ..... | 340/18 |

(Continued)

FOREIGN PATENT DOCUMENTS

| | | | | |
|---|---|---|---|---|
| CN | 102733799 | 6/2014 | ..... | E21B 47/16 |
| EP | 0636763 | 2/1995 | ..... | E21B 47/12 |

(Continued)

OTHER PUBLICATIONS

U.S. Appl. No. 15/666,334, filed Aug. 1, 2017, Walker, Katie M. et al.

(Continued)

*Primary Examiner* — Naomi J Small
(74) *Attorney, Agent, or Firm* — Leandro Arechederra, III

(57) ABSTRACT

A method and system are described for wirelessly communicating along tubular members. The method includes determining, constructing and installing a communication network, which communicates using one or more communication coupling devices along one or more tubular members. The communication network is used to perform operations for a system, such as hydrocarbon operations, which may involve hydrocarbon exploration, hydrocarbon development, and/or hydrocarbon production.

31 Claims, 5 Drawing Sheets

(58) Field of Classification Search
USPC ..... 367/82
See application file for complete search history.

(56) References Cited

U.S. PATENT DOCUMENTS 3,512,407 A 5/1970 Zill ..... 73/152
3,637,010 A 1/1972 Malay et al. ..... 166/51
3,741,301 A 6/1973 Malay et al. ..... 166/191
3,781,783 A 12/1973 Tucker ..... 340/18
3,790,930 A 2/1974 Lamel et al. ..... 340/18
3,900,827 A 8/1975 Lamel et al. ..... 340/18
3,906,434 A 9/1975 Lamel et al. ..... 340/18
4,001,773 A 1/1977 Lamel et al. ..... 340/18
4,283,780 A 8/1981 Nardi ..... 367/82
4,298,970 A 11/1981 Shawhan et al. ..... 367/82
4,302,826 A 11/1981 Kent et al. ..... 367/82
4,314,365 A 2/1982 Petersen et al. ..... 367/82
4,884,071 A 11/1989 Howard ..... 340/854
4,962,489 A 10/1990 Medlin et al. ..... 367/32
5,056,067 A * 10/1991 Drumheller ..... E21B 47/16 367/82
5,128,901 A 7/1992 Drumheller ..... 367/82
5,136,613 A 8/1992 Dumestre, III ..... 375/1
5,166,908 A 11/1992 Montgomery ..... 367/165
5,182,946 A 2/1993 Boughner et al. ..... 13/151
5,234,055 A 8/1993 Cornette ..... 166/278
5,283,768 A 2/1994 Rorden ..... 367/83
5,373,481 A 12/1994 Orban et al. ..... 367/82
5,468,025 A 11/1995 Adinolfe et al. ..... 285/114
5,480,201 A 1/1996 Mercer ..... 294/67.31
5,495,230 A 2/1996 Lian ..... 340/551
5,562,240 A 10/1996 Campbell ..... 227/130
5,592,438 A 1/1997 Rorden et al. ..... 367/83
5,667,650 A 9/1997 Face et al. ..... 204/298.07
5,850,369 A 12/1998 Rorden et al. ..... 367/83
5,857,146 A 1/1999 Kido ..... 455/38.3
5,924,499 A * 7/1999 Birchak ..... E21B 47/20 175/40
5,960,883 A 10/1999 Tubel et al. ..... 166/313
5,995,449 A 11/1999 Green et al. ..... 367/83
6,018,501 A * 1/2000 Smith ..... E21B 47/001 367/134
6,049,508 A 4/2000 Deflandre ..... 367/48
6,125,080 A 9/2000 Sonnenschein et al. ..... 367/134
6,128,250 A 10/2000 Reid et al. ..... 367/153
6,177,882 B1 1/2001 Ringgenberg et al. ..... 340/853.7
6,236,850 B1 5/2001 Desai ..... 455/343
6,239,690 B1 5/2001 Burbidge et al. ..... 340/10.33
6,300,743 B1 10/2001 Patino et al. ..... 320/106
6,320,820 B1 11/2001 Gardner et al. ..... 367/81
6,324,904 B1 12/2001 Ishikawa et al. ..... 13/152.03
6,360,769 B1 3/2002 Brisco ..... 137/268
6,394,184 B2 5/2002 Tolman et al. ..... 166/281
6,400,646 B1 6/2002 Shah et al. ..... 367/82
6,429,784 B1 8/2002 Beique et al. ..... 340/853.2
6,462,672 B1 10/2002 Besson ..... 340/853.2
6,543,538 B2 4/2003 Tolman et al. ..... 166/284
6,670,880 B1 12/2003 Hall et al. ..... 336/132
6,679,332 B2 1/2004 Vinegar et al. ..... 166/373
6,695,277 B1 2/2004 Gallis ..... 241/191
6,702,019 B2 3/2004 Dusterhoft et al. ..... 166/278
6,717,501 B2 4/2004 Hall et al. ..... 336/132
6,727,827 B1 4/2004 Edwards et al. ..... 340/854.9
6,772,837 B2 8/2004 Dusterhoft et al. ..... 166/278
6,816,082 B1 11/2004 Laborde ..... 340/853.3
6,868,037 B2 3/2005 Dasgupta et al. ..... 367/54
6,880,634 B2 4/2005 Gardner et al. ..... 166/250.01
6,883,608 B2 4/2005 Parlar et al. ..... 166/278
6,899,178 B2 5/2005 Tubel ..... 166/313
6,909,667 B2 6/2005 Shah et al. ..... 367/83
6,912,177 B2 6/2005 Smith ..... 367/82
6,920,085 B2 7/2005 Finke et al. ..... 367/83
6,930,616 B2 8/2005 Tang et al. ..... 340/854.4
6,940,392 B2 9/2005 Chan et al. ..... 340/10.4
6,940,420 B2 9/2005 Jenkins ..... 340/855.6
6,953,094 B2 10/2005 Ross et al. ..... 166/381
6,956,791 B2 10/2005 Dopf et al. ..... 367/82
6,980,929 B2 12/2005 Aronstam et al. ..... 702/188
6,987,463 B2 1/2006 Beique et al. ..... 340/856.3
7,006,918 B2 2/2006 Economides et al. ..... 702/1
7,011,157 B2 3/2006 Costley et al. ..... 166/311
7,036,601 B2 5/2006 Berg et al. ..... 166/385
7,051,812 B2 5/2006 McKee et al. ..... 166/305.1
7,064,676 B2 6/2006 Hall et al. ..... 350/853.1
7,082,993 B2 8/2006 Ayoub et al. ..... 166/250.1
7,090,020 B2 8/2006 Hill et al. ..... 166/373
7,140,434 B2 11/2006 Chouzenoux et al. .. 166/250.11
7,219,762 B2 5/2007 James et al. ..... 181/105
7,224,288 B2 5/2007 Hall et al. ..... 340/853.7
7,228,902 B2 6/2007 Oppelt ..... 166/250.02
7,249,636 B2 7/2007 Ohmer ..... 166/383
7,252,152 B2 8/2007 LoGiudice et al. ..... 166/386
7,257,050 B2 8/2007 Stewart et al. ..... 367/82
7,261,154 B2 8/2007 Hall et al. ..... 166/242.2
7,261,162 B2 8/2007 Deans et al. ..... 166/336
7,275,597 B2 10/2007 Hall et al. ..... 166/297
7,277,026 B2 10/2007 Hall et al. ..... 340/854.8
RE40,032 E 1/2008 van Bokhorst et al. ... 455/343.2
7,317,990 B2 1/2008 Sinha et al. ..... 702/6
7,321,788 B2 1/2008 Addy et al. ..... 455/574
7,322,416 B2 1/2008 Burris, II et al. ..... 166/308.1
7,325,605 B2 2/2008 Fripp et al. ..... 166/250.01
7,339,494 B2 3/2008 Shah et al. ..... 340/855.7
7,348,893 B2 3/2008 Huang et al. ..... 340/854.3
7,385,523 B2 6/2008 Thomeer et al. ..... 340/854.8
7,387,165 B2 6/2008 Lopez de Cardenas et al. ..... 166/313
7,411,517 B2 8/2008 Flanagan ..... 340/854.4
7,477,160 B2 1/2009 Lemenager et al. ..... 340/853.1
7,516,792 B2 4/2009 Lonnes et al. ..... 166/308.1
7,551,057 B2 6/2009 King et al. ..... 340/5.72
7,590,029 B2 9/2009 Tingley ..... 367/82
7,595,737 B2 9/2009 Fink et al. ..... 340/854.4
7,602,668 B2 10/2009 Liang et al. ..... 367/25
7,649,473 B2 1/2010 Johnson et al. ..... 340/853.1
7,750,808 B2 7/2010 Masino et al. ..... 340/572.1
7,775,279 B2 8/2010 Marya et al. ..... 166/297
7,787,327 B2 8/2010 Tang et al. ..... 367/27
7,819,188 B2 10/2010 Auzerais et al. ..... 155/250
7,828,079 B2 11/2010 Oothoudt ..... 175/20
7,831,283 B2 11/2010 Ogushi et al. ..... 455/574
7,913,773 B2 3/2011 Li et al. ..... 175/40
7,952,487 B2 5/2011 Montebovi ..... 340/636.1
7,994,932 B2 8/2011 Huang et al. ..... 340/854.3
8,004,421 B2 8/2011 Clark ..... 340/854.4
8,044,821 B2 10/2011 Mehta ..... 340/855.7
8,049,506 B2 11/2011 Lazarev ..... 324/333
8,115,651 B2 2/2012 Camwell et al. ..... 340/853.2
8,117,907 B2 2/2012 Han et al. ..... 73/152.58
8,157,008 B2 4/2012 Lilley ..... 166/253.1
8,162,050 B2 4/2012 Roddy et al. ..... 166/253.1
8,220,542 B2 7/2012 Whitsitt et al. ..... 166/278
8,237,585 B2 8/2012 Zimmerman ..... 340/854.6
8,242,928 B2 8/2012 Prammer ..... 340/853.7
8,276,674 B2 10/2012 Lopez De Cardenas et al. ..... 166/373
8,284,075 B2 10/2012 Fincher et al. ..... 340/854.4
8,284,947 B2 10/2012 Giesbrecht et al. ..... 381/66
8,316,936 B2 11/2012 Roddy et al. ..... 166/253.1
8,330,617 B2 12/2012 Chen et al. ..... 340/854.6
8,347,982 B2 1/2013 Hannegan et al. ..... 175/5
8,358,220 B2 1/2013 Savage ..... 340/853.1
8,376,065 B2 2/2013 Teodorescu et al. ..... 175/40
8,381,822 B2 2/2013 Hales et al. ..... 166/377
8,388,899 B2 3/2013 Mitani et al. ..... 422/179
8,411,530 B2 4/2013 Slocum et al. ..... 367/90
8,434,354 B2 5/2013 Crow et al. ..... 73/152.04
8,494,070 B2 7/2013 Luo et al. ..... 375/262
8,496,055 B2 7/2013 Mootoo et al. ..... 166/278
8,539,890 B2 9/2013 Tripp et al. ..... 109/25
8,544,564 B2 10/2013 Moore et al. ..... 175/50
8,552,597 B2 10/2013 Song et al. ..... 307/149
8,556,302 B2 10/2013 Dole ..... 285/367
8,559,272 B2 10/2013 Wang

(56) References Cited

U.S. PATENT DOCUMENTS 8,596,359 B2 12/2013 Grigsby et al. ..... 166/278
8,605,548 B2 12/2013 Froelich ..... 367/82
8,607,864 B2 12/2013 Mcleod et al. ..... 166/250.1
8,664,958 B2 3/2014 Simon ..... 324/338
8,672,875 B2 3/2014 Vanderveen et al. ..... 604/67
8,675,779 B2 3/2014 Zeppetelle et al. ..... 375/340
8,683,859 B2 4/2014 Godager ..... 73/152.54
8,689,621 B2 4/2014 Godager ..... 73/152.54
8,701,480 B2 4/2014 Eriksen ..... 73/152.51
8,750,789 B2 6/2014 Baldemair et al. ..... 455/11.1
8,787,840 B2 7/2014 Srinivasan et al. ..... 455/69
8,805,632 B2 8/2014 Coman et al. ..... 702/89
8,826,980 B2 9/2014 Neer ..... 166/255.1
8,833,469 B2 9/2014 Purkis ..... 166/373
8,893,784 B2 11/2014 Abad ..... E21B 43/26
8,910,716 B2 12/2014 Newton et al. ..... 166/373
8,994,550 B2 3/2015 Millot et al. ..... E21B 47/16
8,995,837 B2 3/2015 Mizuguchi et al. ... H04B 10/27
9,062,508 B2 6/2015 Huval et al. ..... E21B 47/122
9,062,531 B2 6/2015 Jones ..... E21B 47/082
9,075,155 B2 7/2015 Luscombe et al. .... G01V 1/226
9,078,055 B2 7/2015 Nguyen et al. ..... H04R 5/00
9,091,153 B2 7/2015 Yang et al. ..... E21B 47/12
9,133,705 B2 9/2015 Angeles Boza ..... E21B 47/12
9,140,097 B2 9/2015 Themig et al. ..... E21B 34/12
9,144,894 B2 9/2015 Barnett et al. ..... B25B 17/00
9,206,645 B2 12/2015 Hallundbaek ..... E21B 7/04
9,279,301 B2 3/2016 Lovorn et al. ..... E21B 21/103
9,284,819 B2 3/2016 Tolman et al. ..... E21B 41/00
9,284,834 B2 3/2016 Alteirac et al. ..... E21B 47/12
9,310,510 B2 4/2016 Godager ..... G01V 3/38
9,333,350 B2 5/2016 Rise et al. ..... A61N 1/36082
9,334,696 B2 5/2016 Hay ..... E21B 47/12
9,359,841 B2 6/2016 Hall ..... E21B 23/00
9,363,605 B2 6/2016 Goodman et al. ..... H04R 17/00
9,376,908 B2 6/2016 Ludwig et al. ..... E21B 47/01
9,441,470 B2 9/2016 Guerrero et al. ..... E21B 43/14
9,515,748 B2 12/2016 Jeong et al. ..... G10L 25/90
9,557,434 B2 1/2017 Keller et al. ..... G01V 1/52
9,617,829 B2 4/2017 Dale et al. ..... E21B 41/00
9,617,850 B2 4/2017 Fripp et al. ..... E21B 47/18
9,631,485 B2 4/2017 Keller et al. ..... E21B 47/16
9,657,564 B2 5/2017 Stolpman ..... E21B 47/16
9,664,037 B2 5/2017 Logan et al. ..... E21B 47/122
9,670,773 B2 6/2017 Croux ..... E21B 47/16
9,683,434 B2 6/2017 Machocki ..... E21B 44/00
9,686,021 B2 6/2017 Merino ..... E21B 47/16
9,715,031 B2 7/2017 Contant et al. ..... E21B 47/122
9,721,448 B2 8/2017 Wu et al. ..... G08B 21/20
9,759,062 B2 9/2017 Deffenbaugh et al. ..... E21B 47/16
9,816,373 B2 11/2017 Howell et al. ..... E21B 47/16
9,822,634 B2 11/2017 Gao ..... E21B 47/16
9,863,222 B2 1/2018 Morrow et al. ..... E21B 43/122
9,879,525 B2 1/2018 Morrow et al. ..... E21B 47/12
9,945,204 B2 4/2018 Ross et al. ..... E21B 33/127
9,963,955 B2 5/2018 Tolman et al. ..... E21B 43/119
10,100,635 B2 10/2018 Keller et al. ..... E21B 47/18
10,103,846 B2 10/2018 van Zelm et al. ..... E21B 47/12
10,132,149 B2 11/2018 Morrow et al. ..... E21B 43/267
10,145,228 B2 12/2018 Yarus et al. ..... E21B 44/00
10,167,716 B2 1/2019 Clawson et al. ..... E21B 47/14
10,167,717 B2 1/2019 Deffenbaugh et al. ..... E21B 47/16
10,190,410 B2 1/2019 Clawson et al. ..... E21B 47/14
10,196,862 B2 2/2019 Li-Leger et al. ..... E21B 17/02
2002/0180613 A1 12/2002 Shi et al. ..... E21B 47/18
2003/0056953 A1 3/2003 Tumlin et al. ..... 166/298
2003/0117896 A1 6/2003 Sakuma et al. ..... 367/81
2004/0020063 A1 2/2004 Lewis et al. ..... 33/313
2004/0200613 A1 10/2004 Fripp et al. ..... 166/250.01
2004/0239521 A1 12/2004 Zierolf ..... 340/854.1
2005/0017802 A1* 1/2005 Robinson ..... H03F 1/3223 330/151
2005/0026908 A1 12/2005 Burris, II et al. ..... 166/255.2
2005/0284659 A1 12/2005 Hall et al. ..... 175/27
2006/0033638 A1 2/2006 Hall et al. ..... 340/854.6
2006/0045795 A1 2/2006 Gabelmann et al. ..... 714/699
2006/0090893 A1 5/2006 Sheffield ..... 166/250.15
2007/0139217 A1 6/2007 Beique et al. ..... 340/856.3
2007/0146351 A1 6/2007 Katsurahira et al. ..... 345/179
2007/0156359 A1 7/2007 Varsamis et al. ..... 702/69
2007/0219758 A1 9/2007 Bloomfield ..... 702/190
2007/0272411 A1 11/2007 Lopez De Cardenas et al. ..... 166/305.1
2008/0030365 A1 2/2008 Fripp et al. ..... E21B 47/16
2008/0110644 A1 5/2008 Howell et al. ..... 166/387
2008/0185144 A1 8/2008 Lovell ..... 166/250.17
2008/0304360 A1 12/2008 Mozer ..... 367/117
2009/0003133 A1 1/2009 Dalton et al. ..... 367/82
2009/9030614 1/2009 Carnegie et al. ..... 702/6
2009/0034368 A1 2/2009 Johnson ..... 367/83
2009/0045974 A1 2/2009 Patel ..... 340/854.6
2009/0080291 A1 3/2009 Tubel et al. ..... 367/81
2009/0084185 A1* 4/2009 Reiderman ..... B06B 1/04 73/643
2009/0166031 A1 7/2009 Hernandez ..... 166/250.01
2010/0013663 A1 1/2010 Cavender et al. ..... 340/854.3
2010/0089141 A1 4/2010 Rioufol et al. ..... 73/152.28
2010/0112631 A1 5/2010 Hur et al. ..... 435/39
2010/0133004 A1 6/2010 Burleson et al. ..... 175/2
2010/0182161 A1 7/2010 Robbins et al. ..... 340/853.7
2010/0212891 A1 8/2010 Stewart et al. ..... 166/250.12
2011/0061862 A1 3/2011 Loretz et al. ..... 166/250.11
2011/0066378 A1 3/2011 Lerche et al. ..... 702/6
2011/0168403 A1 7/2011 Patel ..... 166/373
2011/0188345 A1 8/2011 Wang ..... 367/34
2011/0297376 A1 12/2011 Holderman et al. ..... 166/278
2011/0297673 A1 12/2011 Zbat et al. ..... 219/756
2011/0301439 A1 12/2011 Albert et al. ..... 600/301
2011/0315377 A1 12/2011 Rioufol ..... 166/250.17
2012/0043079 A1 2/2012 Wassouf et al. ..... 166/250
2012/0126992 A1 5/2012 Rodney et al. ..... 340/850
2012/0152562 A1 6/2012 Newton et al. ..... 166/369
2012/0179377 A1 7/2012 Lie ..... 702/6
2013/0000981 A1 1/2013 Grimmer et al. ..... 175/45
2013/0003503 A1 1/2013 L'Her et al. ..... 367/106
2013/0106615 A1 5/2013 Prammer ..... 340/854.6
2013/0138254 A1 5/2013 Seals et al. ..... 700/282
2013/0192823 A1 8/2013 Barrilleaux et al. ..... 166/250.01
2013/0278432 A1 10/2013 Shashoua et al. ..... 340/853.7
2013/0319102 A1 12/2013 Riggenberg et al. ..... 13/152.28
2014/0060840 A1 3/2014 Hartshorne et al. ..... 166/300
2014/0062715 A1 3/2014 Clark ..... 340/853.2
2014/0102708 A1 4/2014 Purkis et al. ..... 166/308.1
2014/0133276 A1 5/2014 Volker et al. ..... 367/82
2014/0152659 A1 6/2014 Davidson et al. ..... 345/420
2014/0153368 A1 6/2014 Bar-Cohen et al. ..... 367/81
2014/0166266 A1 6/2014 Read ..... 166/250.01
2014/0170025 A1 6/2014 Weiner et al. ..... 422/82.01
2014/0266769 A1 9/2014 Van Zelm ..... 340/854.3
2014/0327552 A1 11/2014 Filas et al. ..... 340/854.6
2014/0352955 A1 12/2014 Tubel et al. ..... 166/250.15
2015/0003202 A1 1/2015 Palmer et al. ..... 367/82
2015/0009040 A1 1/2015 Bowles et al. ..... 340/854.6
2015/0027687 A1 1/2015 Tubel ..... 166/72
2015/0041124 A1 2/2015 Rodriguez ..... 166/255.1
2015/0041137 A1 2/2015 Rodriguez ..... 166/301
2015/0152727 A1 6/2015 Fripp et al. ..... E21B 47/14
2015/0159481 A1 6/2015 Mebarkia et al. .... E21B 47/065
2015/0167425 A1 6/2015 Hammer et al. ..... E21B 34/06
2015/0176370 A1 6/2015 Greening et al. ..... E21B 41/00
2015/0275657 A1* 10/2015 Deffenbaugh ..... E21B 47/16 340/854.4
2015/0292319 A1 10/2015 Disko et al. ..... E21B 47/16
2015/0292320 A1 10/2015 Lynk et al. ..... E21B 47/16
2015/0300159 A1 10/2015 Stiles et al. ..... E21B 47/16
2015/0330200 A1 11/2015 Richard et al. ..... E21B 44/00
2015/0337642 A1 11/2015 Spacek ..... E21B 44/005
2015/0354351 A1 12/2015 Morrow et al. ..... E21B 47/16
2015/0377016 A1 12/2015 Ahmad ..... E21B 47/122
2016/0010446 A1 1/2016 Logan et al. ..... E21B 47/122
2016/0047230 A1 2/2016 Livescu et al. ..... E21B 47/10
2016/0047233 A1 2/2016 Butner et al. ..... E21B 47/12

(56) References Cited

U.S. PATENT DOCUMENTS

| | | | | |
|---|---|---|---|---|
| 2016/0076363 | A1 | 3/2016 | Morrow et al. | E21B 47/12 |
| 2016/0109606 | A1 | 4/2016 | Market et al. | G01V 1/50 |
| 2016/0215612 | A1 | 7/2016 | Morrow | E21B 47/122 |
| 2017/0138185 | A1 | 5/2017 | Saed et al. | E21B 47/16 |
| 2017/0145811 | A1 | 5/2017 | Robison et al. | E21B 47/0007 |
| 2017/0152741 | A1 | 6/2017 | Park et al. | E21B 47/123 |
| 2017/0167249 | A1 | 6/2017 | Lee et al. | E21B 47/14 |
| 2017/0204719 | A1 | 7/2017 | Babakhani | E21B 47/0005 |
| 2017/0254183 | A1 | 9/2017 | Vasques et al. | E21B 47/16 |
| 2017/0293044 | A1 | 10/2017 | Gilstrap et al. | G01V 1/50 |
| 2017/0314386 | A1 | 11/2017 | Orban et al. | E21B 47/091 |
| 2018/0010449 | A1 | 1/2018 | Roberson et al. | E21B 47/16 |
| 2018/0058191 | A1 | 3/2018 | Romer et al. | E21B 47/0007 |
| 2018/0058198 | A1 | 3/2018 | Ertas et al. | E21B 47/12 |
| 2018/0058202 | A1 | 3/2018 | Disko et al. | E21B 47/14 |
| 2018/0058203 | A1 | 3/2018 | Clawson et al. | E21B 47/14 |
| 2018/0058204 | A1 | 3/2018 | Clawson et al. | E21B 47/14 |
| 2018/0058205 | A1 | 3/2018 | Clawson et al. | E21B 47/14 |
| 2018/0058206 | A1 | 3/2018 | Zhang et al. | E21B 47/16 |
| 2018/0058207 | A1* | 3/2018 | Song | E21B 47/005 |
| 2018/0058208 | A1 | 3/2018 | Song et al. | E21B 47/16 |
| 2018/0058209 | A1 | 3/2018 | Song et al. | E21B 47/16 |
| 2018/0066490 | A1 | 3/2018 | Kjos | E21B 33/035 |
| 2018/0066510 | A1 | 3/2018 | Walker et al. | E21B 47/011 |
| 2018/0135408 | A1* | 5/2018 | Cooley | E21B 47/13 |
| 2019/0112913 | A1 | 4/2019 | Song et al. | E21B 47/01 |
| 2019/0112915 | A1 | 4/2019 | Disko et al. | E21B 47/14 |
| 2019/0112916 | A1 | 4/2019 | Song et al. | E21B 47/14 |
| 2019/0112917 | A1 | 4/2019 | Disko et al. | E21B 47/14 |
| 2019/0112918 | A1 | 4/2019 | Yi et al. | E21B 4/16 |
| 2019/0112919 | A1 | 4/2019 | Song et al. | E21B 47/16 |
| 2019/0116085 | A1 | 4/2019 | Zhang et al. | H04L 12/24 |

FOREIGN PATENT DOCUMENTS

| | | | |
|---|---|---|---|
| EP | 1409839 | 4/2005 | E21B 43/1185 |
| EP | 2677698 | 12/2013 | H04L 12/28 |
| WO | WO2002/027139 | 4/2002 | E21B 43/12 |
| WO | WO2010/074766 | 7/2010 | A41C 1/14 |
| WO | WO2013/079928 | 6/2013 | E21B 47/12 |
| WO | WO2014/018010 | 1/2014 | E21B 47/12 |
| WO | WO2014/049360 | 4/2014 | E21B 47/12 |
| WO | WO2014/100271 | 6/2014 | E21B 47/12 |
| WO | WO2014/134741 | 9/2014 | E21B 47/13 |
| WO | WO2015/117060 | 8/2015 | E21B 47/12 |

OTHER PUBLICATIONS

U.S. Appl. No. 16/175,441, filed Oct. 30, 2018, Song, Limin et al.
U.S. Appl. No. 16/175,467, filed Oct. 30, 2018, Kinn, Timothy F. et al.
U.S. Appl. No. 16/175,488, filed Oct. 30, 2018, Yi, Xiaohua et al.
U.S. Appl. No. 16/220,327, filed Dec. 14, 2018, Disko, Mark M. et al.
U.S. Appl. No. 16/220,332, filed Dec. 14, 2018, Yi, Xiaohua et al.
U.S. Appl. No. 16/269,083, filed Feb. 6, 2019, Zhang, Yibing.
U.S. Appl. No. 16/267,950, filed Feb. 5, 2019, Walker, Katie M. et al.
U.S. Appl. No. 62/782,153, filed Dec. 19, 2019, Yi, Xiaohua et al.
U.S. Appl. No. 62/782,160, filed Dec. 19, 2018, Hall, Timothy J. et al.
Arroyo, Javier et al. (2009) "Forecasting Histogram Time Series with K-Nearest Neighbours Methods," *International Journal of Forecasting*, v.25, pp. 192-207.
Arroyo, Javier et al. (2011) "Smoothing Methods for Histogram-Valued Time Seriers: An Application to Value-at-Risk," *Univ. of California, Dept. of Economics*, www.wileyonlinelibrary.com, Mar. 8, 2011, 28 pages.
Arroyo, Javier et al. (2011) "Forecasting with Interval and Histogram Data Some Financial Applications," *Univ. of California, Dept. of Economics*, 46 pages.
Emerson Process Management (2011), "Roxar downhole Wireless PT sensor system," www.roxar.com, or downhole@roxar.com, 2 pgs.
Gonzalez-Rivera, Gloria et al. (2012) "Time Series Modeling of Histogram-Valued Data: The Daily Histogram Time Series of S&P500 Intradaily Returns," *International Journal of Forecasting*, v.28, 36 pgs.
Gutierrez-Estevez, M. A. et al. (2013) "Acoustic Boardband Communications Over Deep Drill Strings using Adaptive OFDM", *IEEE Wireless Comm. & Networking Conf.*, pp. 4089-4094.
Qu, X. et al. (2011) "Reconstruction fo Self-Sparse 20 NMR Spectra From undersampled Data In The Indirect Dimension", pp. 8888-8909.
U.S. Department of Defense (1999) "Interoperability and Performance Standards for Medium and High Frequency Radio Systems," MIL-STD-188-141B, Mar. 1, 1999, 584 pages.
U.S. Appl. No. 62/588,054, filed Nov. 17, 2017, Song, Limin et al.
U.S. Appl. No. 62/588,067, filed Nov. 17, 2017. Song, Limin et al.
U.S. Appl. No. 62/588,103, filed Nov. 17, 2017, Yi, Xiaohua et al.
U.S. Appl. No. 16/139,373, filed Sep. 24, 2018, Yi, Xiaohua et al.
U.S. Appl. No. 16/139,384, filed Sep. 24, 2018, Disko, Mark M. et al.
U.S. Appl. No. 16/139,394, filed Sep. 24, 2018, Song, Limin et al.
U.S. Appl. No. 16/139,414, filed Sep. 24, 2018, Zhang, Yibing et al.
U.S. Appl. No. 16/139,421, filed Sep. 24, 2018, Song, Limin et al.
U.S. Appl. No. 16/139,427, filed Sep. 24, 2018, Disko, Mark M. et al.

* cited by examiner

METHOD AND SYSTEM FOR PERFORMING WIRELESS ULTRASONIC COMMUNICATIONS ALONG TUBULAR MEMBERS

CROSS REFERENCE TO RELATED APPLICATION

This application claims the benefit of U.S. Provisional Application Ser. No. 62/588,080, filed Nov. 17, 2018, entitled "Method and System for Performing Wireless Ultrasonic Communications along Tubular Members," the disclosure of which is incorporated herein by reference in its entirety.

This application is related to U.S. Patent Publication No. 2018/0058207, published Mar. 1, 2018 entitled "Dual Transducer Communications Node for Downhole Acoustic Wireless Networks and Method Employing Same," U.S. Publication No. 2018/005206 published Mar. 1, 2018 entitled "Communication Networks, Relay Nodes for Communication Networks, and Methods of Transmitting Data Among a Plurality of Relay Nodes," U.S. Publication No. 2018/0058208, published Mar. 1, 2018 entitled "Hybrid Downhole Acoustic Wireless Network," U.S. Publication No. 2018/0058203, published Mar. 1, 2018 entitled "Methods of Acoustically Communicating and Wells that Utilize the Methods," U.S. Publication No. 2018/0058209, published Mar. 1, 2018 entitled "Downhole Multiphase Flow Sensing Methods," U.S. Publication No. 2018/0066510, published Mar. 8, 2018 entitled "Acoustic Housing for Tubulars," the disclosures of which are incorporated herein by reference in their entireties.

This application is related to U. S. Patent Applications having common inventors and assignee: U.S. patent application Ser. No. 16/139,414, filed Sep. 24, 2018 entitled "Method and System for Performing Operations using Communications," U.S. patent application Ser. No. 16/139,394, filed Sep. 24, 2018 entitled "Method and System for Performing Communications using Aliasing," U.S. patent application Ser. No. 16/139,427, filed Sep. 24, 2018 entitled "Method and System for Performing Operations with Communications," U.S. patent application Ser. No. 16/139,421, filed Sep. 24, 2018 entitled "Method and System for Performing Wireless Ultrasonic Communications along a Drilling String," U.S. patent application Ser. No. 16/139,384, filed Sep. 24, 2018 entitled "Method and System for Performing Hydrocarbon Operations with Mixed Communication Networks," U.S. Provisional Application No. 62/588,054, filed Nov. 17, 2017 entitled "Method and System for Performing Communications During Cementing Operations," U.S. patent application Ser. No. 16/139,373, filed Sep. 24, 2018 entitled "Vertical Seismic Profiling," U.S. Provisional Application No. 62/588,067, filed Nov. 17, 2017 entitled "Method and System for Performing Operations using Communications for a Hydrocarbon System," and U.S. Provisional Application No. 62/588,103, filed Nov. 17, 2017 entitled "Method and System for Performing Hydrocarbon Operations using Communications Associated with Completions," the disclosures of which are incorporated herein by reference in their entireties.

FIELD OF THE INVENTION

This disclosure relates generally to the field of acoustically communicating with communication nodes along tubular members. Specifically, the disclosure relates to methods and systems for acoustically communicating with communication nodes disposed along one or more tubular members to enhance operations.

BACKGROUND

This section is intended to introduce various aspects of the art, which may be associated with exemplary embodiments of the present disclosure. This discussion is believed to assist in providing a framework to facilitate a better understanding of particular aspects of the present invention. Accordingly, it should be understood that this section should be read in this light, and not necessarily as admissions of prior art.

The exchange of information may be used to manage the various types of operations for a system. By way of example, several real-time data systems or methods have been proposed in hydrocarbon exploration, hydrocarbon development, and/or hydrocarbon production operations. To exchange information, the devices may communicate with physical connections or wireless connections. As a first example, a physical connection, such as a cable, an electrical conductor or a fiber optic cable, is secured to a tubular member, which may be used to evaluate subsurface conditions. The cable may be secured to an inner portion of the tubular member and/or an outer portion of the tubular member. The cable provides a physical or hard-wire connection to provide real-time transmission of data. Further, the cables may be used to provide high data transmission rates and the delivery of electrical power directly to downhole devices, such as sensors. However, the use of physical cables may be difficult as the cables have to be unspooled and attached to the tubular member sections disposed within a wellbore. As a result, the cables may be damaged by other operations within the wellbore and/or may be damaged during installation of the tubular members (e.g., in installations that involve rotating the tubular members). Further, passages have to be provided in certain downhole equipment to provide a physical path for the cables. These passages introduce additional potential failure points, and may have to be provided in equipment not even associated with the communication network, which may increase costs for hydrocarbon operations.

As an alternative to physical connection or hard-wired configurations, wireless connections or technologies may be used for communications along tubular members. Such technologies are referred to as wireless telemetry. A wireless network may include various communication nodes that exchange information with each other to manage data communication within the wellbore. In addition, a computer system may also be in communication with the wireless network to manage the hydrocarbon operations from a surface location. To operate, the communication nodes may involve different wireless network types. As a first example, radio transmissions may be used for wellbore communications. However, the use of radio transmissions may be impractical or unavailable in certain environments or during certain operations, such as drilling operations. Other systems may use an acoustic wireless network to transmit an acoustic signal, such as a vibration, via a tone transmission medium. In general, a given tone transmission medium may only permit communication within a certain frequency range; and, in some systems, this frequency range may be relatively small. Such systems may be referred to herein as spectrum-constrained systems. An example of a spectrum-constrained system may include a well, such as a hydrocarbon well, that includes a plurality of communication nodes spaced-apart along a length of tubular members thereof. Indeed, downhole environments may include conditions within a wellbore that are unknown and unpredictable. These conditions are more complicated when hydrocarbon operations are being performed within the wellbore, which may result in varying fluid compositions (e.g., gas, water and oil) and/or varying activities being performed within the wellbore (e.g., rotating machines, drilling or production vibration and the like).

While the wireless network along tubular members may be beneficial, conventional data transmission mechanisms may not be effective and may be problematic to operate. Indeed, with increasing data requirements from downhole operations, such as drilling, completion monitoring, and reservoir management, increasing number of downhole sensors are utilized to provide the required data. Currently, most of sensors are clamped to the tubular member or attached to the tubular member to provide reliable performance. These types of sensors typically involve extensive labor work to install and maintain along with the associated delays to the rig schedule.

Accordingly, there remains a need in the industry for methods and systems that are more efficient and may lessen problems associated with noisy and ineffective communication. Further, a need remains for efficient approaches to perform acoustic communications along tubular members, which may manage the transmitted signals to enhance the communication within the system during operations. The present techniques provide methods and systems that overcome one or more of the deficiencies discussed above.

SUMMARY

In one embodiment, a method of communicating data among a plurality of communication nodes for a system is described. The method comprising: determining a communication network, wherein the communication network comprises a plurality of communication nodes; configuring the plurality of communication nodes, wherein each of the plurality of communication nodes is configured to transmit signals between two or more of the plurality of communication nodes along a plurality of tubular members; providing a plurality of communication coupling devices, wherein each of the plurality of communication coupling devices is configured to enclose one or more of the communication nodes from the plurality of communication nodes within an interior region of the communication coupling device; installing each of the plurality of communication coupling devices between two tubular members of the plurality of tubular members in the system; communicating operational data between two or more of the plurality of communication nodes during operations for the system; and performing operations based on the operational data.

The method may include various enhancements. The method may include wherein installing each of the plurality of communication coupling devices between two tubular members of the plurality of tubular members further comprises: mechanically coupling the communication coupling device to a first tubular member of the plurality of tubular members, and mechanically coupling the communication coupling device to a second tubular member of the plurality of tubular members; wherein the mechanically coupling the communication coupling device to the first tubular member comprises threading the communication coupling device to the first tubular member, and wherein the mechanically coupling the communication coupling device to the second tubular member comprises threading the communication coupling device to the second tubular member; wherein the mechanically coupling the communication coupling device to the first tubular member comprises welding the communication coupling device to the first tubular member, and wherein the mechanically coupling the communication coupling device to the second tubular member comprises welding the communication coupling device to the second tubular member; wherein the mechanically coupling the communication coupling device to the first tubular member comprises securing a flange of the communication coupling device to a flange of the first tubular member, and wherein the mechanically coupling the communication coupling device to the second tubular member comprises securing a flange of the communication coupling device to a flange of the second tubular member; further comprising: identifying parameters to measure in the system, and wherein one or more of the plurality of communication coupling devices is configured to enclose one or more sensors within the interior region, wherein each of the one or more sensors is configured to measure a parameter associated with the system; wherein at least one of the one or more sensors is configured to obtain measurements internally within the plurality of tubular members; wherein at least one of the one or more sensors is configured to obtain measurements externally from the tubular members; wherein the parameter associated with the system comprises one or more of pressure, temperature, flow rate, sound, vibrations, resistivity, impedance, capacitance, infrared, gamma ray, and any combination thereof; wherein each of the plurality of communication nodes are configured to transmit signals between two or more of the plurality of communication nodes in an omnidirectional mode or a directional mode, and wherein the transmission of the operational data is performed in a directional mode or in an omnidirectional mode; wherein each of the plurality of communication nodes comprise one or more transducers; wherein each of the plurality of communication nodes comprise a first array of transducers and a second array of transducers; wherein the transducers in the first array of transducers is circumferentially spaced apart about a perimeter of at least one of the plurality of communication coupling devices and the transducers in the second array of transducers is circumferentially spaced apart about the perimeter of at least one of the plurality of communication coupling devices; wherein the transducers in the first array of transducers is equidistantly spaced apart about a perimeter of one of the plurality of communication coupling devices and the transducers in the second array of transducers is equidistantly spaced apart about the perimeter of one of the plurality of communication coupling devices; wherein the first array of transducers are disposed on a first end of the communication coupling device and the second array of transducers are disposed on a second end of the communication coupling device; wherein the first array of transducers comprises at least one transducer configured to transmit data packets away from the communication coupling device at the first end and at least one transducer configured to receive data packets, and wherein the second array of transducers comprises at least one transducer configured to transmit data packets away from the communication coupling device at the second end and at least one transducer configured to receive data packets; wherein the first array of transducers is configured to generate one or more signals to provide constructive interference to one or more signals received at the second end; wherein the first array of transducers and the second array of transducers are configured to exchange acoustic signals with other communication nodes of the plurality of communication nodes, and are configured to exchange signals between the first array of transducers and the second array of transducers via a physical connection; wherein the each of the plurality of communication nodes are configured comprises: receiving one or more signals in one of the plurality of communication nodes, and filtering the one or more signals using a high pass filter to lessen background noise from the one or more signals in the one of the plurality of communication nodes; wherein the communicating operational data between two or more of the plurality of communication nodes during the operations for the system further comprises transmitting the operational data through a portion of the plurality of the tubular members between the two or more of the plurality of communication nodes; wherein communicating operational data between two or more of the plurality of communication nodes during the operations for the system further comprises transmitting the operational data through a portion of the fluid adjacent to the plurality of the tubular members between the two or more of the plurality of communication nodes; wherein the communicating between the plurality of communication nodes comprises exchanging high-frequency signals that are greater than (>) 20 kilohertz; wherein the communicating between the plurality of communication nodes comprises exchanging high-frequency signals that are in the range between greater than 20 kilohertz and 1 megahertz; wherein the communicating between the plurality of communication nodes comprises exchanging high-frequency signals that are in the range between greater than 100 kilohertz and 500 kilohertz; and/or further comprising performing hydrocarbon operations with the operational data.

In one embodiment, a system for communicating along a plurality of tubular members for a system is described. The system comprises: a plurality of tubular members associated with a system; a communication network associated with the system, wherein the communication network comprises a plurality of communication nodes that are configured to communicate operational data between two or more of the plurality of communication nodes during operations; and a plurality of communication coupling devices, wherein each of the plurality of communication coupling devices is configured to enclose one or more of the communication nodes from the plurality of communication nodes within an interior region of the communication coupling device and each of the plurality of communication coupling devices are secured between two of the plurality of tubular members.

The system may include various enhancements. The system may include wherein one or more of the plurality of communication coupling devices is configured to enclose at least one sensor within the interior region, wherein each of the at least one sensor is configured to measure a parameter associated with the system; wherein the at least one sensor is configured to obtain measurements internally within the plurality of tubular members; wherein at least one sensor is configured to obtain measurements externally from the tubular members; wherein the measurements comprises pressure, temperature, flow rate, sound, vibration, resistivity, impedance, capacitance, infrared, gamma ray, and any combination thereof; wherein each of the plurality of communication nodes are configured to transmit signals between two or more of the plurality of communication nodes in an omnidirectional mode or a directional mode, and wherein the transmission of the operational data is performed in a directional mode or in an omnidirectional mode; wherein each of the plurality of communication nodes comprise one or more transducers; wherein each of the plurality of communication nodes comprise a first array of transducers and a second array of transducers; wherein the transducers in the first array of transducers are circumferentially spaced apart about a perimeter of at least one of the plurality of communication coupling devices and the transducers in the second array of transducers are circumferentially spaced apart about the perimeter of at least one of the plurality of communication coupling devices; wherein the transducers in the first array of transducers is equidistantly spaced apart about a perimeter of one of the plurality of communication coupling devices and the transducers in the second array of transducers is equidistantly spaced apart about the perimeter of one of the plurality of communication coupling devices; wherein the first array of transducers are disposed on a first end of the communication coupling device and the second array of transducers are disposed on a second end of the communication coupling device; wherein the first array of transducers comprises at least one transducer configured to transmit data packets away from the communication coupling device at the first end and at least one transducer configured to receive data packets, and wherein the second array of transducers comprises at least one transducer configured to transmit data packets away from the communication coupling device at the second end and at least one transducer configured to receive data packets; wherein the first array of transducers is configured to generate one or more signals to provide constructive interference to one or more signals received at the second end; wherein the first array of transducers and the second array of transducers are configured to exchange acoustic signals with other communication nodes of the plurality of communication nodes, and are configured to exchange signals between the first array of transducers and the second array of transducers via a physical connection; wherein the each of the plurality of communication nodes are configured comprises: receiving one or more signals in one of the plurality of communication nodes, and filtering the one or more signals using a high pass filter to lessen background noise from the one or more signals in the one of the plurality of communication nodes; wherein the each of the plurality of communication nodes are configured to exchange high-frequency signals that are greater than (>) 20 kilohertz; wherein the each of the plurality of communication nodes are configured to exchange high-frequency signals that are in the range between greater than 20 kilohertz and 1 megahertz and/or wherein the each of the plurality of communication nodes are configured to exchange high-frequency signals that are in the range between greater than 100 kilohertz and 500 kilohertz.

BRIEF DESCRIPTION OF THE DRAWINGS

The advantages of the present invention are better understood by referring to the following detailed description and the attached drawings.

DETAILED DESCRIPTION

Figure 1:
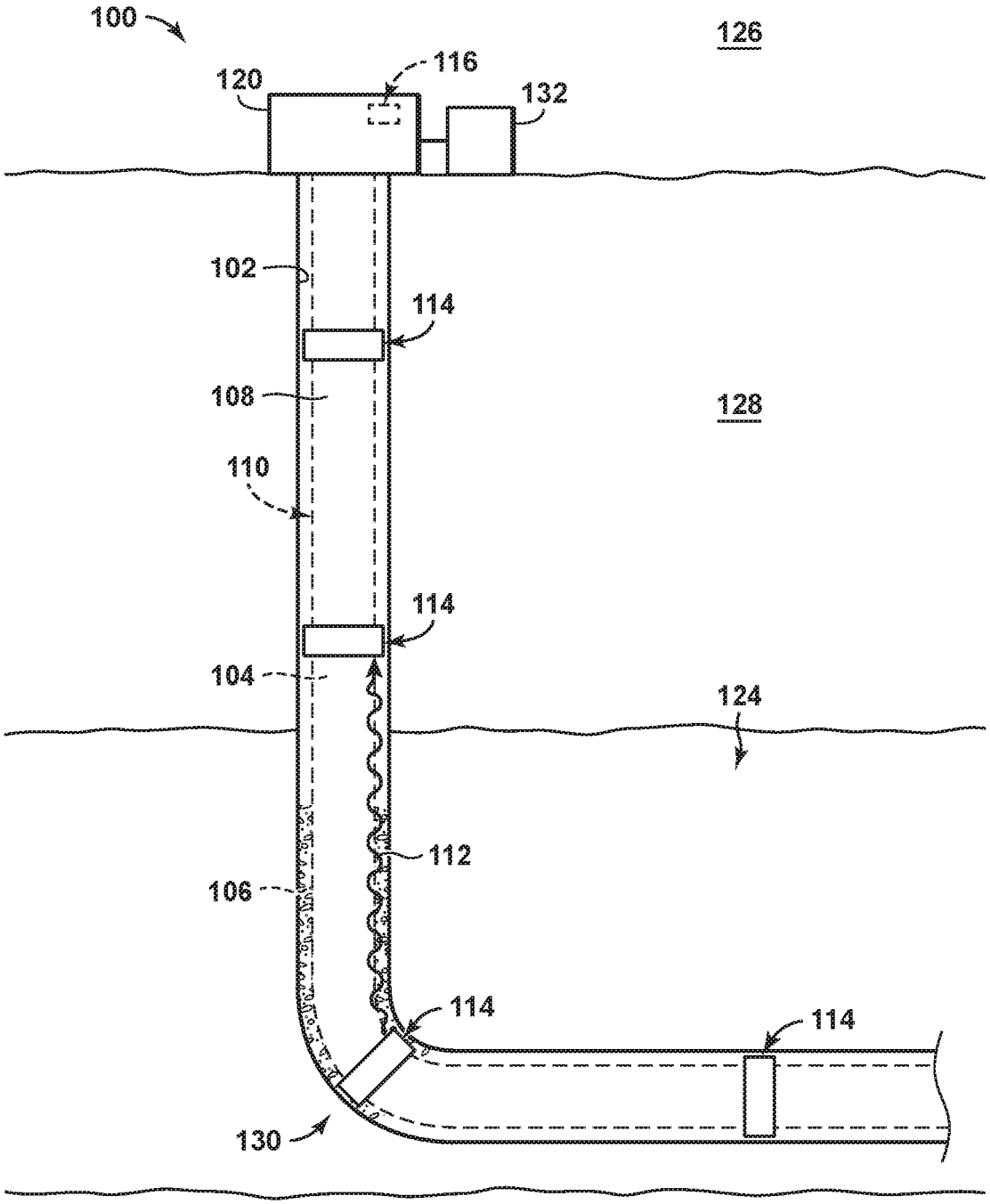
FIG. 1 is a schematic representation of a well configured to utilize the methods according to the present disclosure.

In the following detailed description section, the specific embodiments of the present disclosure are described in connection with preferred embodiments. However, to the extent that the following description is specific to a particular embodiment or a particular use of the present disclosure, this is intended to be for exemplary purposes only and simply provides a description of the exemplary embodiments. Accordingly, the disclosure is not limited to the specific embodiments described below, but rather, it includes all alternatives, modifications, and equivalents falling within the true spirit and scope of the appended claims.

Various terms as used herein are defined below. To the extent a term used in a claim is not defined below, it should be given the broadest definition persons in the pertinent art have given that term as reflected in at least one printed publication or issued patent.

The articles "the", "a", and "an" are not necessarily limited to mean only one, but rather are inclusive and open ended so as to include, optionally, multiple such elements.

The directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

As used herein, the term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of" "only one of" or "exactly one of".

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

As used herein, "any" means one, some, or all indiscriminately of whatever quantity.

As used herein, "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

As used herein, "based on" does not mean "based only on", unless expressly specified otherwise. In other words, the phrase "based on" describes both "based only on," "based at least on," and "based at least in part on."

As used herein, "conduit" refers to a tubular member forming a channel through which something is conveyed. The conduit may include one or more of a pipe, a manifold, a tube or the like. Any use of any form of the terms "connect", "engage", "couple", "attach", or any other term describing an interaction between elements is not meant to limit the interaction to direct interaction between the elements and may also include indirect interaction between the elements described.

As used herein, "determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

As used herein, "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

As used herein, "exemplary" is used exclusively herein to mean "serving as an example, instance, or illustration." Any embodiment described herein as "exemplary" is not necessarily to be construed as preferred or advantageous over other embodiments.

As used herein, "formation" refers to any definable subsurface region. The formation may contain one or more hydrocarbon-containing layers, one or more non-hydrocarbon containing layers, an overburden, and/or an underburden of any geologic formation.

As used herein, "hydrocarbons" are generally defined as molecules formed primarily of carbon and hydrogen atoms such as oil and natural gas. Hydrocarbons may also include other elements or compounds, such as, but not limited to, halogens, metallic elements, nitrogen, oxygen, sulfur, hydrogen sulfide ($H_2S$), and carbon dioxide ($CO_2$). Hydrocarbons may be produced from hydrocarbon reservoirs through wells penetrating a hydrocarbon containing formation. Hydrocarbons derived from a hydrocarbon reservoir may include, but are not limited to, petroleum, kerogen, bitumen, pyrobitumen, asphaltenes, tars, oils, natural gas, or combinations thereof. Hydrocarbons may be located within or adjacent to mineral matrices within the earth, termed reservoirs. Matrices may include, but are not limited to, sedimentary rock, sands, silicilytes, carbonates, diatomites, and other porous media.

As used herein, "hydrocarbon exploration" refers to any activity associated with determining the location of hydrocarbons in subsurface regions. Hydrocarbon exploration normally refers to any activity conducted to obtain measurements through acquisition of measured data associated with the subsurface formation and the associated modeling of the data to identify potential locations of hydrocarbon accumulations. Accordingly, hydrocarbon exploration includes acquiring measurement data, modeling of the measurement data to form subsurface models, and determining the likely locations for hydrocarbon reservoirs within the subsurface. The measurement data may include seismic data, gravity data, magnetic data, electromagnetic data, and the like. The hydrocarbon exploration activities may include drilling operations, such as drilling exploratory wells.

As used herein, "hydrocarbon development" refers to any activity associated with planning of extraction and/or access to hydrocarbons in subsurface regions. Hydrocarbon development normally refers to any activity conducted to plan for access to and/or for production of hydrocarbons from the subsurface formation and the associated modeling of the data to identify preferred development approaches and methods. By way of example, hydrocarbon development may include modeling of the subsurface formation and extraction planning for periods of production, determining and planning equipment to be utilized and techniques to be utilized in extracting the hydrocarbons from the subsurface formation, and the like.

As used herein, "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° Celsius (C) and 1 atmospheric (atm) pressure). Hydrocarbon fluids may include, for example, oil, natural gas, gas condensates, coal bed methane, shale oil, shale gas, and other hydrocarbons that are in a gaseous or liquid state.

As used herein, "hydrocarbon operations" refers to any activity associated with hydrocarbon exploration, hydrocarbon development and/or hydrocarbon production.

As used herein, "hydrocarbon production" refers to any activity associated with extracting hydrocarbons from subsurface location, such as a well or other opening. Hydrocarbon production normally refers to any activity conducted to form the wellbore along with any activity in or on the well after the well is completed. Accordingly, hydrocarbon production or extraction includes not only primary hydrocarbon extraction, but also secondary and tertiary production techniques, such as injection of gas or liquid for increasing drive pressure, mobilizing the hydrocarbon or treating by, for example, chemicals, hydraulic fracturing the wellbore to promote increased flow, well servicing, well logging, and other well and wellbore treatments. The hydrocarbon production operations may include drilling operations, such as drilling additional wells for injection and/or production operations, which may be subsea wells, from a drilling platform or surface location.

As used herein, "operatively connected" and/or "operatively coupled" means directly or indirectly connected for transmitting or conducting information, force, energy, or matter.

As used herein, "optimal", "optimizing", "optimize", "optimality", "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; and/or 6) seeking to maximize one or more factors in light of competing and/or cooperative interests in maximizing, minimizing, or otherwise controlling one or more other factors, etc.

As used herein, "potting" refers to the encapsulation of electrical components with epoxy, elastomeric, silicone, or asphaltic or similar compounds for the purpose of excluding moisture or vapors. Potted components may or may not be hermetically sealed.

As used herein, "range" or "ranges", such as concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, "sealing material" refers to any material that can seal a cover of a housing to a body of a housing sufficient to withstand one or more downhole conditions including but not limited to, for example, temperature, humidity, soil composition, corrosive elements, pH, and pressure.

As used herein, "sensor" includes any electrical sensing device or gauge. The sensor may be capable of monitoring or detecting pressure, temperature, fluid flow, vibration, resistivity, or other formation data. Alternatively, the sensor may be a position sensor.

As used herein, "stream" refers to fluid (e.g., solids, liquid and/or gas) being conducted through various regions, such as equipment and/or a formation. The equipment may include conduits, vessels, manifolds, units or other suitable devices.

As used herein, "subsurface" refers to geologic strata occurring below the earth's surface.

As used herein, "tubular member" or "tubular body" refer to any pipe, such as a joint of casing, a portion of a liner, a drill string, a production tubing, an injection tubing, a pup joint, a buried pipeline, underwater piping, or above-ground piping. Solid lines therein, and any suitable number of such structures and/or features may be omitted from a given embodiment without departing from the scope of the present disclosure.

As used herein, "wellbore" or "downhole" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

As used herein, "zone", "region", "container", or "compartment" is a defined space, area, or volume contained in the framework or model, which may be bounded by one or more objects or a polygon encompassing an area or volume of interest. The volume may include similar properties.

The exchange of information may be used to manage the operations for different technologies. By way of example, the communication network may include communication nodes disposed along one or more tubular members. The communication nodes may be distributed along tubular members, such as casing or drilling string, pipeline or subsea conduits, to enhance associated operations. To exchange information, the communication network may include physically connected communication nodes, wirelessly connected communication nodes or a combination of physically connected communication nodes and wirelessly connected communication nodes. However, the attachment of the communication nodes may be problematic for certain operations of the system.

By way of example, the communication network may be used for data exchanges of operational data, which may be used for real-time or concurrent operations as part of hydrocarbon exploration operations, hydrocarbon development operations, and/or hydrocarbon production operations, for example. The system or method may involve communicating via a communication network (which may be in a downhole environment) including various communication nodes spaced-apart along a length of tubular members, which may be a tone transmission medium (e.g., conduits). The communication nodes may communicate with each other to manage the exchange of data for the system and with a computer system that is utilized to manage the operations for the system. For example, the communication network may involve transmitting and/or receiving signals or tones via one or more frequencies of acoustic tones in the form of data packets via the tubular member. The wireless communication through the tubular member may be beneficial for enhancing hydrocarbon operations, such as optimizing drilling. In such communications, the communication network may include communication nodes that utilize ultrasonic acoustic frequencies to exchange information.

The communication nodes may include a housing that isolates various components from the respective environment. For example, the communication nodes may include one or more encoding components, which may be configured to generate and/or to induce one or more acoustic tones via a tone transmission medium, such as a tubular member. In addition, the communication nodes may include one or more decoding components, which may be configured to receive and/or decode acoustic tones from the tone transmission medium. The decoding components may include filters to modify the received signals, which may include a high pass filter to eliminate and/or reduce the noise, for example. The communication nodes may include one or more power supplies configured to supply power to the other components, such as batteries. The communication nodes may include one or more sensors, which may be configured to obtain measurement data associated with the associated environment, the associated formation and/or the associated equipment. The communication nodes may include relatively small transducers to lessen the size and energy demand of the communication nodes, such that each of the communication nodes may be disposed or secured to locations having limited clearance, such as between successive layers of tubular members. The smaller transducers have higher acoustic resonant frequencies compared to larger transducers and thus use less energy to send acoustic signals around the resonant frequency band as compared with the larger transducers.

To manage the transmission and reception of signals, the communication nodes may include a processor that operates to manage the communications along one or more tubular members. For example, the present techniques may utilize ultrasonic communication system for hydrocarbon operation. The system may include a number of communication nodes disposed along the tubular member. Each communication node may include one or more encoding components (e.g., transmitters) and one or more decoding components (receivers) that are configured to transmit and receive data packets represented by ultrasonic frequencies. The communication frequencies utilized on the communication network by the communication nodes may be selected so that the signals are outside of the ranges of background noises, such as mud flow noise, rotating machine vibrational noise, rock-cutting noise, traffic noise and any other noises that may be present during operations.

As may be appreciated, data requirements for various systems continue to increase. By way of example, various operations, such as drilling, completion monitoring, and reservoir management, involve large numbers of sensors that are installed along tubular members to obtain data for the system. Conventional configurations include sensors that are clamped to casing and/or tubing (e.g., clamp type sensors) or are designed as an in-line tool (e.g., in-line type sensors) to provide reliable performance. The in-line tool is a tool installed in-between tubular member and/or some other systems. The in-line tool or sensor may also have the screws at two ends to connect with other tubular members. The lengths of the in-line tools may vary, as it is not a standard installation and thus may involve extra effort as comparing with standard collar operation. Unfortunately, the installation of clamp type sensors or in-line type sensors involves extensive labor and may potentially delay operations. Similarly, wireless communication networks may be used for similar installation approaches, pre-attaching communication nodes on casings prior to installation into a wellbore. This type of installation typically involves extensive and time consuming labor to provide proper alignment between the communication nodes along with verifying sufficient mechanical bonding.

The present techniques provide a mechanism for exchanging data packets through a communication network of communication nodes through the associated environment that utilizes communication coupling devices, such as collars, joint subs, coupling tools and/or other suitable coupling devices to house the communication nodes and sensors. As communication coupling devices are utilized to mechanically couple two tubular members (e.g., drilling strings and/or casings), the communication coupling devices may be configured to house sensors and communication nodes in addition to providing mechanical connections between two adjacent tubular members. The configuration may evenly distribute the communication coupling devices along the length of the tubular members and may provide strong mechanical connections, which may also serve as a platform for sensors. The present techniques integrate communication nodes and sensors within the communication coupling devices to simplify the installation process and to enhance effective installation of sensors to measure parameters within the tubular members in addition to measuring parameters associated with the tubular members (e.g., interior of the tubular member and/or exterior of the tubular member). The communication coupling devices may be used with the tubular members to provide various enhancements for improved telemetry and acoustic sensing via a more symmetric environment for ultrasonic wave generation and detection.

By way of example, each of the communication coupling devices may include one or more sensors and one or more communication nodes in different configurations. In one configuration, each of the communication coupling devices may include coupling mechanisms (e.g., flange, welds, threads) to connect two joints of casing and/or tubing. Such a configuration may include sufficient mechanical strength to maintain the two joints during a casing run, as well as being cemented within the wellbore.

In another configuration, the sensors may be configured to obtain measurements internally and/or externally depending on parameters being measured. The sensors may be configured to measure certain properties, such as pressure, temperature, flow rate, sound, vibrations, resistivity, impedance (e.g., alternating current (AC) impedance), capacitance, infrared, gamma ray, and any combination thereof. If measurements are related to material and/or conditions inside of the tubular member, the sensors may be configured to obtain measurements within the internal surface of the coupling communication devices. Accordingly, the communication coupling device may include a configuration that does not intrude on the flow path or interfere with the fluid flow within the internal surface. Similarly, if measurements are related to material and/or conditions external of the tubular member, the sensors may be configured to externally measure properties of material and/or conditions external to the communication coupling device. Further, the sets of internal sensors and external sensors may be installed on the same communication coupling device and may be configured to obtain measurements in different directions (e.g., external to the external surface communication coupling device and/or internal to the internal surface communication coupling device).

By way of example, the communication nodes may include one or more sensors that may be configured to measure certain properties. For example, the communication node may measure impendence that may be used to provide information about fluid compositions within the stream. In particular, AC impedance is an electrical measurement that provides sensing data by using electrodes. The alternating field may be coupled with media (e.g., water different from oil from air) and measured then via an AC impedance measurement from electrodes that operate as antennas. The flow measurements may include addition processing that is performed on the communication node, which may then pass a notification to the control unit or other communication nodes. As another example, the communication node may measure infrared data that may be used to provide information about properties within the media and/or stream.

In yet another configuration, the communication coupling device may include performing ultrasonic telemetry and sensing in specific frequency bands. As an example, the communication network may utilize low-frequency ranges and/or high-frequency ranges (e.g., may include low-frequency communication nodes and/or high-frequency communication nodes). The low-frequency communication nodes may be configured to transmit signals and to receive signals that are less than or equal to (≤) 200 kHz, ≤100 kHz, ≤50 kHz, or ≤20 kHz. In particular, the low-frequency communication nodes may be configured to exchange signals in the range between 100 Hz and 20 kHz; in the range between 1 kHz and 20 kHz; and in the range between 5 kHz and 20 kHz. Other configurations may include low-frequency communication nodes, which may be configured to exchange signals in the range between 100 Hz and 200 kHz; in the range between 100 Hz and 100 kHz; in the range between 1 kHz and 200 kHz; in the range between 1 kHz and 100 kHz; in the range between 5 kHz and 100 kHz and in the range between 5 kHz and 200 kHz. The communication nodes may also include high-frequency communication nodes configured to transmit and receive signals that are greater than (>) 20 kHz, >50 kHz, >100 kHz or >200 kHz. Also, the high-frequency communication nodes may be configured to exchange signals in the range between greater than 20 kHz and 1 MHz, in the range between greater than 20 kHz and 750 kHz, in the range between greater than 20 kHz and 500 kHz. Other configurations may include high-frequency communication nodes, which may be configured to exchange signals in the range between greater than 100 kHz and 1 MHz; in the range between greater than 200 kHz and 1 MHz; in the range between greater than 100 kHz and 750 kHz; in the range between greater than 200 kHz and 750 kHz; in the range between greater than 100 kHz and 500 kHz; and in the range between greater than 200 kHz and 500 kHz.

In such configurations, the low frequency bands and/or high-frequency bands may utilize piezoelectric systems to enhance operations. The communication coupling device may include piezo transducers that may be coupled to the environment to be sensed (e.g., pulse echo from piezo assembly behind a thin steel wall and thus proximate flowing media, hydrates, sand, which may be within the tubular member). The configurations may include the use of acoustic or other transducer arrays spaced on an azimuth. Such transducer arrays may be used to launch single mode acoustic or vibrational waves that may be tailored for one or more of: (i) long distance telemetry, (ii) focusing the acoustic energy in steel tubular, or within media, or outside of surface of tubular, (iii) for one or more piezoelectric transducers, the termination properties, coupling to adjoining tubular members, and preferable acoustic wave properties that may be enhanced by the radial design versus a point or wide line attachment.

In still yet another configuration, the electronic circuits are present within the communication coupling device (e.g., including the communication nodes) to process the collected measurement data, store the data for transmission, and conduct necessary on-board computation to simplify data for transmission. Local detection of faulty data, data compression, and automated communication with neighboring sensors may be carried out with the on-board electronics, signal processing components and microprocessor.

In another configuration, the communication coupling device may include communication nodes (e.g., configured to function as a transmitter and/or receiver) for data transmission to topside or other devices. In other embodiments, multiple different types of devices may be connected. For example, if it is an acoustic system, piezos may be facilitated as a transmitter and a receiver to relay data back to topside or other wireline tools. If it is an electromagnetic system, then radio-frequency receivers with communication frequency ranges may be integrated.

In other configurations, the communication coupling device may include communication nodes (e.g., configured to function as a transmitter and/or receiver) that may be oriented to receive and/or transmit inside the tubular member, outside the tubular member and/or a combination thereof. The range of the communication nodes may be extended by broadcasting directly into the tubular member versus receiving and transmitting on the exterior of the tubular member. In addition, the reliability and quality of the acoustic transmission when broadcasting into the tubular member may be enhanced.

In addition, other configurations may include the communication coupling device may include communications nodes integrated into communication coupling device, such as a collar or sub joint. Such an integration may save time by avoiding an added step of clamping the communication nodes onto the tubular members prior to installation. This integration may include enhancing reliability by eliminating the field installation and potential of improper or poor mating of the communication nodes to the tubular member. The integration may avoid cost and/or the complexity of external communication nodes communicating with the communication coupling device, which may be necessary for measure of pressure directly in flow zone or annulus. Telemetry electronics and/or hardware along with sensors in an integrated package that may maintain communication node physical integrity, while enhancing accuracy of in-flow zone measurements.

In addition to the variations on the configurations noted above, the communication coupling device may include different types of sensors, such as sonic logging components and/or an imaging measurement components. In such configurations, the communication coupling device may include additional power supplies, such as batteries, to drive an array of acoustic sources or a single acoustic source to generate sufficient acoustic energy to perform sonic logging or obtaining imaging measurements, where the source may be triggered by a communication node.

By way of example, the sensors may include a sonic log component. The sonic log component may operate by emitting a large acoustic pulse on the communication coupling device, which is disposed near the end of the tubular member. Similar to a conventional sonic logging techniques, an acoustic wave may travel along the tubular member, along with any associated cement, and any associated formation, with sufficient energy to be detected by the communication nodes. Using sonic logging interpretation techniques, the data may be used to evaluate fractures, permeability, porosity, lithology, or fluid type in the nearby formation, and/or to evaluate the cement before and after perforation. Assessing some of these properties may involve additional data or knowledge of the system (e.g., well data).

Another example, the sensors may be imaging measurement components that perform various imaging techniques (e.g., daylight imaging). For example, acoustic (or seismic) imaging may use a combination of source and/or receiver to form an image of a material between source and receiver pairs. Daylight imaging involves forming an image between pairs of receivers (e.g., not source or receiver pairs) using ambient background noise. Accordingly, the communication coupling device may be used to create the ambient noise so that daylight imaging techniques may be applied to downhole wireless receiving nodes to form an image of the surrounding media. The imaging measurement components may be configured to obtain an impulse function, which may be referred to Green's function or transfer function, between communication nodes. Preferably, the present techniques may involve simultaneously having certain communication nodes being a high intensity acoustic emitter and acoustic receiver. This provides a mechanism to probe the acoustic properties (e.g., by using the impulse function) between any two communication nodes by transmitting an acoustic signal from one communication node to another communication node, but the energy requirements may be a limiting factor. As a result, communication nodes may operate as both a receiver and transmitter, which may utilize more power. The more power may increase cost and size for each communication node. To form an acoustic image of the surrounding media, many of the communication nodes may be converted into a receiver and transmitter. Accordingly, one or more acoustic sources on the communication coupling device and maintaining the communication nodes as low cost receivers. As a result, daylight imaging may be applied to form an image of the surrounding media. Such capability may provide the user data or insight about zonal isolation around the cement, lithology in the nearby formation, or fractures in the nearby formation. By taking a different approach, one may probe the acoustic properties between any pair of communication nodes using a method known as daylight imaging, where each communication node is a receiver. In addition to the communication nodes, a few random acoustic generators placed along the tubular members (e.g., these may be placed on the communication coupling device with a battery to drive the emitter with sufficient acoustic energy. Based on the implementation and objectives, many random acoustic generators may be utilized and may be placed at specific locations. When the random acoustic generators are activated, the random acoustic generators may emit uncorrelated acoustic waves of random amplitude and the random phase that may be collected by the communication nodes as it travels. By way of example, the cross correlation of the signals measured at any two communication nodes A and B provides a direct measurement of the impulse function between the communication nodes A and B. The impulse function is the acoustic signal that may be measured if the acoustic signal is transmitted from the communication node A to the communication node B. In particular, if there are a total of m communication nodes, then the impulse function may be computed for the $m^2$-m communication node pairs simultaneously. One embodiment may be to perform the measurements before and after the perforation of different stages. By comparing the impulse functions before and after perforation between adjacent communication nodes with a perforation in between the communication nodes, the change in the impulse function may relate to the size and extent of the perforation.

In another configuration, a method of communicating data among a plurality of communication nodes for a system is described. The method comprising: determining a communication network, wherein the communication network comprises a plurality of communication nodes; configuring the plurality of communication nodes, wherein each of the plurality of communication nodes is configured to transmit signals between two or more of the plurality of communication nodes along a plurality of tubular members; providing a plurality of communication coupling devices, wherein each of the plurality of communication coupling devices is configured to enclose one or more of the communication nodes from the plurality of communication nodes within an interior region of the communication coupling device; installing each of the plurality of communication coupling devices between two tubular members of the plurality of tubular members in the system; communicating operational data between two or more of the plurality of communication nodes during operations for the system; and performing operations based on the operational data.

The method may include various enhancements. The method may include wherein installing each of the plurality of communication coupling devices between two tubular members of the plurality of tubular members further comprises: mechanically coupling the communication coupling device to a first tubular member of the plurality of tubular members, and mechanically coupling the communication coupling device to a second tubular member of the plurality of tubular members; wherein the mechanically coupling the communication coupling device to the first tubular member comprises threading the communication coupling device to the first tubular member, and wherein the mechanically coupling the communication coupling device to the second tubular member comprises threading the communication coupling device to the second tubular member; wherein the mechanically coupling the communication coupling device to the first tubular member comprises welding the communication coupling device to the first tubular member, and wherein the mechanically coupling the communication coupling device to the second tubular member comprises welding the communication coupling device to the second tubular member; wherein the mechanically coupling the communication coupling device to the first tubular member comprises securing a flange of the communication coupling device to a flange of the first tubular member, and wherein the mechanically coupling the communication coupling device to the second tubular member comprises securing a flange of the communication coupling device to a flange of the second tubular member; further comprising: identifying parameters to measure in the system, and wherein one or more of the plurality of communication coupling devices is configured to enclose one or more sensors within the interior region, wherein each of the one or more sensors is configured to measure a parameter associated with the system; wherein at least one of the one or more sensors is configured to obtain measurements internally within the plurality of tubular members; wherein at least one of the one or more sensors is configured to obtain measurements externally from the tubular members; wherein the parameter associated with the system comprises one or more of pressure, temperature, flow rate, sound, vibrations, resistivity, impedance, capacitance, infrared, gamma ray, and any combination thereof; wherein each of the plurality of communication nodes are configured to transmit signals between two or more of the plurality of communication nodes in an omnidirectional mode or a directional mode, and wherein the transmission of the operational data is performed in a directional mode or in an omnidirectional mode; wherein each of the plurality of communication nodes comprise one or more transducers; wherein each of the plurality of communication nodes comprise a first array of transducers and a second array of transducers; wherein the transducers in the first array of transducers is circumferentially spaced apart about a perimeter of at least one of the plurality of communication coupling devices and the transducers in the second array of transducers is circumferentially spaced apart about the perimeter of at least one of the plurality of communication coupling devices; wherein the transducers in the first array of transducers is equidistantly spaced apart about a perimeter of one of the plurality of communication coupling devices and the transducers in the second array of transducers is equidistantly spaced apart about the perimeter of one of the plurality of communication coupling devices; wherein the first array of transducers are disposed on a first end of the communication coupling device and the second array of transducers are disposed on a second end of the communication coupling device; wherein the first array of transducers comprises at least one transducer configured to transmit data packets away from the communication coupling device at the first end and at least one transducer configured to receive data packets, and wherein the second array of transducers comprises at least one transducer configured to transmit data packets away from the communication coupling device at the second end and at least one transducer configured to receive data packets; wherein the first array of transducers is configured to generate one or more signals to provide constructive interference to one or more signals received at the second end; wherein the first array of transducers and the second array of transducers are configured to exchange acoustic signals with other communication nodes of the plurality of communication nodes, and are configured to exchange signals between the first array of transducers and the second array of transducers via a physical connection; wherein the each of the plurality of communication nodes are configured comprises: receiving one or more signals in one of the plurality of communication nodes, and filtering the one or more signals using a high pass filter to lessen background noise from the one or more signals in the one of the plurality of communication nodes; wherein the communicating operational data between two or more of the plurality of communication nodes during the operations for the system further comprises transmitting the operational data through a portion of the plurality of the tubular members between the two or more of the plurality of communication nodes; wherein communicating operational data between two or more of the plurality of communication nodes during the operations for the system further comprises transmitting the operational data through a portion of the fluid adjacent to the plurality of the tubular members between the two or more of the plurality of communication nodes; wherein the communicating between the plurality of communication nodes comprises exchanging high-frequency signals that are greater than (>) 20 kilohertz; wherein the communicating between the plurality of communication nodes comprises exchanging high-frequency signals that are in the range between greater than 20 kilohertz and 1 megahertz; wherein the communicating between the plurality of communication nodes comprises exchanging high-frequency signals that are in the range between greater than 100 kilohertz and 500 kilohertz; and/or further comprising performing hydrocarbon operations with the operational data.

In yet another configuration, a system for communicating along a plurality of tubular members for a system is described. The system comprises: a plurality of tubular members associated with a system; a communication network associated with the system, wherein the communication network comprises a plurality of communication nodes that are configured to communicate operational data between two or more of the plurality of communication nodes during operations; and a plurality of communication coupling devices, wherein each of the plurality of communication coupling devices is configured to enclose one or more of the communication nodes from the plurality of communication nodes within an interior region of the communication coupling device and each of the plurality of communication coupling devices are secured between two of the plurality of tubular members.

The system may include various enhancements. The system may include wherein one or more of the plurality of communication coupling devices is configured to enclose at least one sensor within the interior region, wherein each of the at least one sensor is configured to measure a parameter associated with the system; wherein the at least one sensor is configured to obtain measurements internally within the plurality of tubular members; wherein at least one sensor is configured to obtain measurements externally from the tubular members; wherein the measurements comprises pressure, temperature, flow rate, sound, vibration, resistivity, impedance, capacitance, infrared, gamma ray, and any combination thereof; wherein each of the plurality of communication nodes are configured to transmit signals between two or more of the plurality of communication nodes in an omnidirectional mode or a directional mode, and wherein the transmission of the operational data is performed in a directional mode or in an omnidirectional mode; wherein each of the plurality of communication nodes comprise one or more transducers; wherein each of the plurality of communication nodes comprise a first array of transducers and a second array of transducers; wherein the transducers in the first array of transducers are circumferentially spaced apart about a perimeter of at least one of the plurality of communication coupling devices and the transducers in the second array of transducers are circumferentially spaced apart about the perimeter of at least one of the plurality of communication coupling devices; wherein the transducers in the first array of transducers is equidistantly spaced apart about a perimeter of one of the plurality of communication coupling devices and the transducers in the second array of transducers is equidistantly spaced apart about the perimeter of one of the plurality of communication coupling devices; wherein the first array of transducers are disposed on a first end of the communication coupling device and the second array of transducers are disposed on a second end of the communication coupling device; wherein the first array of transducers comprises at least one transducer configured to transmit data packets away from the communication coupling device at the first end and at least one transducer configured to receive data packets, and wherein the second array of transducers comprises at least one transducer configured to transmit data packets away from the communication coupling device at the second end and at least one transducer configured to receive data packets; wherein the first array of transducers is configured to generate one or more signals to provide constructive interference to one or more signals received at the second end; wherein the first array of transducers and the second array of transducers are configured to exchange acoustic signals with other communication nodes of the plurality of communication nodes, and are configured to exchange signals between the first array of transducers and the second array of transducers via a physical connection; wherein the each of the plurality of communication nodes are configured comprises: receiving one or more signals in one of the plurality of communication nodes, and filtering the one or more signals using a high pass filter to lessen background noise from the one or more signals in the one of the plurality of communication nodes; wherein the each of the plurality of communication nodes are configured to exchange high-frequency signals that are greater than (>) 20 kilohertz; wherein the each of the plurality of communication nodes are configured to exchange high-frequency signals that are in the range between greater than 20 kilohertz and 1 megahertz and/or wherein the each of the plurality of communication nodes are configured to exchange high-frequency signals that are in the range between greater than 100 kilohertz and 500 kilohertz.

Beneficially, the present techniques provide various enhancements to the operations. The present techniques provide reliable acoustic and/or electrical connections that may be fabricated prior to deployment to lessen problems with installation, and then may be configured and deployed with minimal effort (e.g., attached to tubular members, such drilling pipe, casing and/or production tubular. In addition, the communication coupling device may provide enhanced communication paths without having to couple (e.g., strap, glue or weld) communication nodes on tubular members during installation operations when disposing the tubular members into the wellbore. Further, the communication coupling device may be wired together to enable phased array acoustics or electromagnetic transceivers with the advantage of sensing (e.g., waves interrogate inside or outside of communication coupling device to greater or lesser extent), radio frequencies or sound wave types that sense flowing phases, cement, cement fluid, elastomeric seal, integrity and/or reservoir properties, such as formation quality, penetration of proppant and fracturing fluids, strain and fracture formation in formation, and/or motion of production fluids including oil and/or gas. Additionally, the present techniques may include more reliable, faster and lower error rates acoustic or electromagnetic network formation. The transducers (e.g., receiver and transmitter transducers) at both ends of a communication coupling device to avoid the losses, which may be up to 90% loss of acoustic energy) that may be avoided by receiver transducer at one end and may be coupled to the transmitter transducer at other end (e.g., these may be wired together). Accordingly, the present techniques may be further understood with reference to FIGS. 1 to 4F, which are described further below.

FIG. 1 is a schematic representation of a well 100 configured that utilizes a network having the proposed configuration of communication nodes. The well 100 includes a wellbore 102 that extends from surface equipment 120 to a subsurface region 128. Wellbore 102 also may be referred to herein as extending between a surface region 126 and subsurface region 128 and/or as extending within a subterranean formation 124 that extends within the subsurface region. The wellbore 102 may include a plurality of tubular sections, which may be formed of carbon steel, such as a casing or liner. Subterranean formation 124 may include hydrocarbons. The well 100 may be a hydrocarbon well, a production well, and/or an injection well.

Well 100 also includes an acoustic wireless network. The acoustic wireless network also may be referred to herein as a downhole acoustic wireless network that includes various communication coupling devices 114, which may include communication nodes along with sensors, and a topside communication node 116 and/or control unit 132. The communication coupling devices 114 may be spaced-apart along a tone transmission medium 130 that extends along a length of wellbore 102. In the context of well 100, the tone transmission medium 130 may include a downhole tubular 110 that may extend within wellbore 102, a wellbore fluid 104 that may extend within wellbore 102, a portion of subsurface region 128 that is proximal wellbore 102, a portion of subterranean formation 124 that is proximal wellbore 102, and/or a cement 106 that may extend within wellbore 102 and/or that may extend within an annular region between wellbore 102 and downhole tubular 110. Downhole tubular 110 may define a fluid conduit 108.

The communication coupling devices 114 may include one or more communication nodes, which may include one or more encoding components, which may be configured to generate an acoustic tone, such as acoustic tone 112, and/or to induce the acoustic tone within tone transmission medium 130. Communication nodes also may include one or more decoding components, which may be configured to receive acoustic tone 112 from the tone transmission medium. The communication nodes may function as both an encoding component and a decoding component depending upon whether the given node is transmitting an acoustic tone (e.g., functioning as the encoding component) or receiving the acoustic tone (e.g., functioning as the decoding component). The communication nodes may include both encoding and decoding functionality, or structures, with these structures being selectively utilized depending upon whether or not the given communication node is encoding the acoustic tone or decoding the acoustic tone. In addition, the communication coupling devices 114 may include sensors that are utilized to measure, control, and monitor conditions within the wellbore 102.

In wells 100, transmission of acoustic tone 112 may be along a length of wellbore 102. As such, the transmission of the acoustic tone is substantially axial along the tubular member, and/or directed, such as by tone transmission medium 130. Such a configuration may be in contrast to more conventional wireless communication methodologies, which generally may transmit a corresponding wireless signal in a plurality of directions, or even in every direction.

The communication coupling devices may include communication nodes and sensors, which are discussed in more detail herein, are disclosed in the context of well 100, such as a hydrocarbon well. However, it is within the scope of the present disclosure that these methods may be utilized to communicate via an acoustic tones in any suitable network, such as any acoustic wireless communication network. As examples, the communication network may be used in a subsea well and/or in the context of a subsea tubular member that extends within a subsea environment. Under these conditions, the tone transmission medium may include, or be, the subsea tubular member and/or a subsea fluid that extends within the subsea environment, proximal to the subsea tubular member, and/or within the subsea tubular member. As another example, the communication network in the context of a surface tubular that extends within the surface region. Under these conditions, the tone transmission medium may include, or be, the surface tubular member and/or a fluid that extends within the surface region, proximal to the surface tubular member, and/or within the surface tubular member.

The plurality of frequencies, which are utilized in the communication nodes, may include the first frequency for a first type of communication node type and/or a second frequency for a second type of communication node type. Each of the wireless network types may be utilized in different configurations to provide the communication for the hydrocarbon operations. The respective frequency ranges may be any suitable values. As examples, each frequency in the plurality of high-frequency ranges may be at least 20 kilohertz (kHz), at least 25 kHz, at least 50 kHz, at least 60 kHz, at least 70 kHz, at least 80 kHz, at least 90 kHz, at least 100 kHz, at least 200 kHz, at least 250 kHz, at least 400 kHz, at least 500 kHz, and/or at least 600 kHz. Additionally or alternatively, each frequency in the plurality of high-frequency ranges may be at most 1,000 kHz (1 megahertz (MHz)), at most 800 kHz, at most 750 kHz, at most 600 kHz, at most 500 kHz, at most 400 kHz, at most 200 kHz, at most 150 kHz, at most 100 kHz, and/or at most 80 kHz. Further, each frequency in the low-frequency ranges may be at least 20 hertz (Hz), at least 50 Hz, at least 100 Hz, at least 150 Hz, at least 200 Hz, at least 500 Hz, at least 1 kHz, at least 2 kHz, at least 3 kHz, at least 4 kHz, and/or at least 5 kHz. Additionally or alternatively, each frequency in the high-frequency ranges may be at most 10 kHz, at most 12 kHz, at most 14 kHz, at most 15 kHz, at most 16 kHz, at most 17 kHz, at most 18 kHz, and/or at most 20 kHz.

Figure 2A:
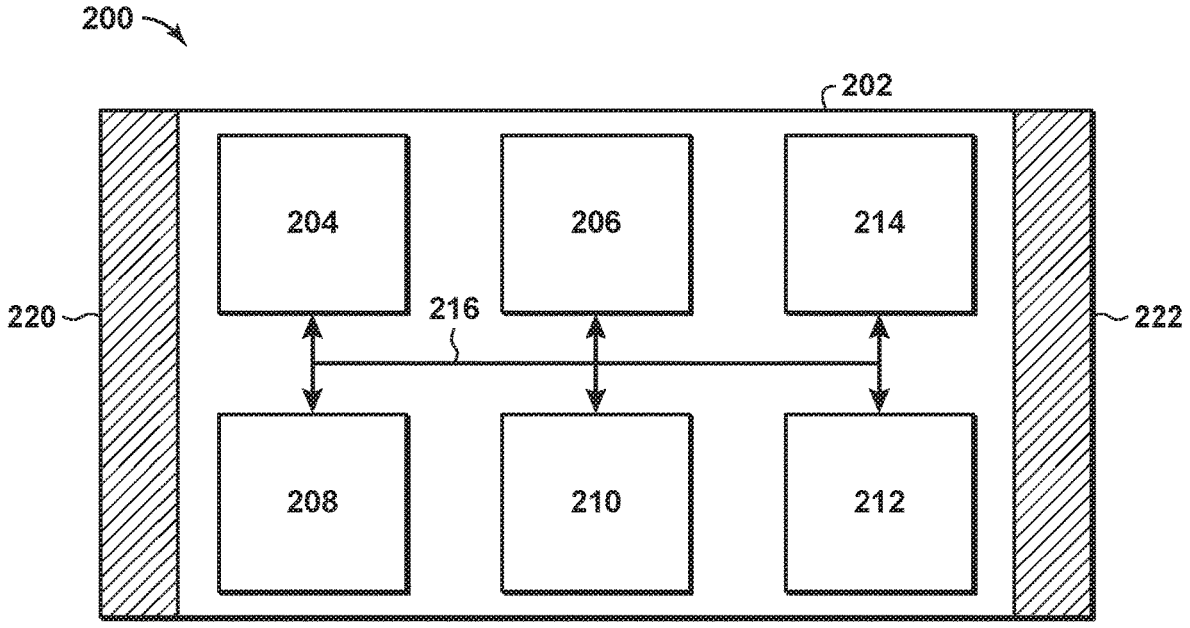
FIGS. 2A and 2B are exemplary views of communication coupling devices of FIG. 1.
Figure 2B:
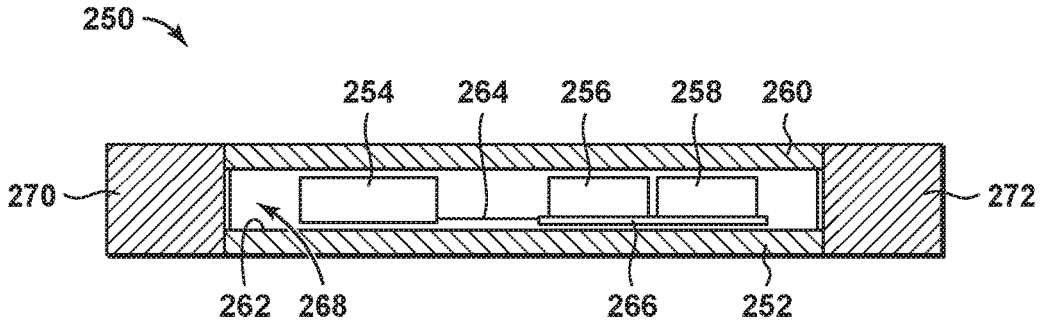

The communication coupling devices may include various configurations, such as those described in FIGS. 2A and 2B. The communication coupling devices may be disposed between tubular members (e.g., conduit and/or tubular section) within the wellbore, between tubular members in subsea conduits, and/or between tubular members of a pipeline. The communication coupling devices may include communication nodes and/or sensors that may be associated with equipment, may be associated with tubular members and/or may be associated with the surface equipment. The communication nodes may also be configured to transmit and receive communication, internal or external surfaces of tubular members, fluids within the communication coupling devices, fluids external to the communication coupling devices, and/or to equipment.

As a specific example, the communication coupling devices may be structured and arranged to interact with other tubular members (e.g., mechanically coupling two or more tubular members) at a selected locations. The communication coupling devices may include communication nodes configured to interact with one or more surfaces (e.g., internal surfaces and/or external surface) of tubular members. The communication coupling devices may also include one or more sensors. By way of example, the communication coupling devices may be disposed in a wellbore environment as an intermediate communications node disposed between the surface and any communication nodes associated with the equipment. By attaching between tubular members, the communication coupling devices and associated communication nodes and/or sensors may not interfere with the flow of fluids within the internal bore of the tubular section.

FIG. 2A is a diagram 200 of an exemplary communication coupling device. The communication coupling device 200 may include a housing 202 with a first mechanical coupling 220 and a second mechanical coupling 222. The first mechanical coupling 220 and a second mechanical coupling 222 may be one or more of flanges, welds, threads and/or any combination thereof. Within the housing 202, communication coupling device may include a central processing unit (CPU) 204, memory 206, and/or a power component 212, a bus 216, one or more sensing components 214 (e.g., sensors) and/or one or more communication nodes, which may include one or more encoding components 208 and/or one or more decoding components 210. The central processing unit (CPU) 204 may be any general-purpose CPU, although other types of architectures of CPU 204 may be used as long as CPU 204 supports the inventive operations as described herein. The CPU 204 may execute the various logical instructions according to disclosed aspects and methodologies. For example, the CPU 204 may execute machine-level instructions for performing processing according to aspects and methodologies disclosed herein. The CPU 204 may contain two or more microprocessors that operate at one or more clock speeds. The CPU 204 may be a system on chip (SOC), digital signal processor (DSP), application specific integrated circuits (ASIC), and field programmable gate array (FPGA), or a combination of these. The memory 206 may include random access memory (RAM), such as static RAM (SRAM), dynamic RAM (DRAM), synchronous DRAM (SDRAM), or the like, read-only memory (ROM), such as programmable ROM (PROM), erasable PROM (EPROM), electronically erasable PROM (EEPROM), or the like, and NAND flash and/or NOR flash. The bus 216 may provide a mechanism for communication between components in the communication coupling device. The one and/or more sensing components 214 may be configured to obtain sensing data and communicate the sensing data with the other communication nodes. Further, the power component 212 may be disposed in the housing 202 and may be configured to provide power to the other components. The power component 212 may include one or more batteries, capacitors, super-capacitors, or other energy storage components. The first mechanical coupling 220 and a second mechanical coupling 222 may be configured to form a coupling between the communication coupling device and respective tubular member.

To manage the communications, the communication coupling device 200 may include one or more communication nodes that are represented by the one or more encoding components 208 and one or more decoding components 210 within the housing 202. The encoding components 208 may be disposed within the housing 202 and may be configured to generate an acoustic tones and/or to induce the acoustic tone within a tone transmission medium. The one or more decoding components 210 may be disposed within the housing 202 and may be configured to receive acoustic tones from the tone transmission medium.

The encoding components 208 and the decoding components 210 may manage the signals (e.g., the transmission or reception of the signals, respectively) through the operation of a processor. To provide the different modes of operation, such as the omnidirectional mode and the directional mode, the encoding component 208 may include an array configuration that includes two or more transducers. The transducers may include a piezoelectric transmitter stack, an in-plane shear d36-type PMNT piezoelectric wafer, and/or an electromagnetic acoustic transmitter. The communication nodes may include an array configuration that may be configured to transmit a signal in one direction and dampen the transmitted signal in the opposite direction or to transmit a signal in various directions (e.g., in a directional mode or in an omnidirectional mode). The relative phase among the multiple transducers in an array may be adjusted to generate specific mode of guided waves. The encoding component may include different transducers spaced apart along a communication coupling device, which may be disposed secured along the circumference of the communication coupling device. The array configuration may include an array of transducers configured in one or more rings of transducers and/or other shape of transducers. Each of the transducers in the array configuration may be circumferentially spaced apart, or equidistantly or equally spaced apart, about a perimeter of the communication coupling device and may be configured to operate with each other to manage the transmission of the data packets and reception of the data packets. In particular, the array of transducers may be utilized to generate signals that lessen or cancel out the signals generated by the one of the other transducers. In certain configuration, the encoding component may be an array of transducers, three arrays of transducers or even four arrays of transducers. Other configurations may include angle beam transducers, which have a transducer and a wedge are used to provide a selected angle. By controlling each element width, spacing, acoustic frequency and bandwidth of excitation, and relative time delay of activation on each transducer, the acoustic wave may be generated along the communication coupling device or the associated tubular members. The angle beam transducers may be arranged into the configuration of arrays. Accordingly, the encoding components may provide omnidirectional transmissions or directional transmissions, which may be based on the preferred mode of communication for a data packet or communication node.

In yet another exemplary configuration, FIG. 2B is an exemplary cross sectional diagram of a communication coupling device 250 that may be used in the system. The view of the communication coupling device 250 is along the longitudinal axis. The communication coupling device 250 includes a housing 252, which may be fabricated from carbon steel or other suitable material to avoid corrosion at the coupling. The housing 252 is dimensioned to provide sufficient structural strength to protect internal electronics. An interior region or cavity 262 houses the electronics, including, by way of example and not of limitation, a power source 254 (e.g., one or more batteries), a power supply wire 264, a first set of transducers 256, a second set of transducers 258, and a circuit board 266. The circuit board 266 may preferably include one or more microprocessors and/or one or more electronics modules that processes acoustic signals. Also, the set of transducers 256 and 258 may be electro-acoustic transducers.

For communication between communication nodes, the first set of transducers 256 and the second set of transducers 258 may be configured to convert acoustical energy to electrical energy (or vice-versa) and are acoustically coupled with outer wall 260 on the side attached to the tubular member. As an example, the first set of transducers 256, which may be configured to receive acoustic signals, and a second set of transducers 258, which may be configured to transmit acoustic signals (e.g., transmitter), are disposed in the cavity 262 of the housing 252. The first and second sets of transducers 256 and 258 provide a mechanism for acoustic signals to be transmitted and received from node-to-node, along the tubular members (e.g., either up the wellbore or down the wellbore or up a subsea pipe or down a subsea pipe). In certain configurations, the second set of transducers 258, which may be configured to serve as transmitters, for the communication nodes may also produce acoustic telemetry signals, which may be directional or omnidirectional. Also, an electrical signal is delivered to the set of transducers 258 via a driver circuit. By way of example, a signal generated in one of the transducers, such as the second set of transducers 258, passes through the housing 252 to the tubular member, and propagates along the tubular member to other communication nodes. As a result, the transducers that generates or receives acoustic signals may be a magnetostrictive transducer (e.g., including a coil wrapped around a core) and/or a piezoelectric ceramic transducer. By way of example, the communication nodes may be configured to transmit using a smaller piezoelectric transducer at high-frequencies (in a preferred embodiment, around their resonant frequency bands), which may lessen the energy usage to transmit signals within the wellbore. Regardless of the specific type of transducer, the electrically encoded data are transformed into a sonic wave that is carried through the walls of a tubular member in the wellbore. Accordingly, the transducers may be configured to only receive signals, to only transmit signals or to receive signals and transmit signals.

Further, the internal components of the communication coupling device 250 may include a protective layer 268. The protective layer 268 encapsulates the electronics circuit board 266, the cable 264, the power source 254, and transducers 256 and 258. This protective layer 268 may provide additional mechanical durability and moisture isolation. The communication coupling device 250 may also be fluid sealed within the housing 252 to protect the internal electronics from exposure to undesirable fluids and/or to maintain dielectric integrity within the voids of a housing. One form of protection for the internal electronics is available using a potting material.

To secure the communication node to the tubular member, the communication coupling device 250 may include a first coupling 270 and a second coupling 272. More specifically, the communication coupling device 250 may include a pair of couplings 270 and 272 disposed at opposing ends of the wall 260. Each of the couplings 270 and 272 provides a mechanism (e.g., a mechanical mechanism) to form a secure bond to the respective tubular member. The first coupling 270 and a second coupling 272 may also have an optional acoustic coupling material (not shown) under the protective outer layer 268. The first coupling 270 and a second coupling 272 may include different types of couplings based on the respective tubular member and the associated coupling of the tubular member.

In other configurations, the communication coupling device may include various different housings that are configured to house the transducers for set of transducers and may communicate with each other. This configuration may be connected to the tubular member, as noted above, and may include cables to exchange communications between the electronics within the separate housings.

To enhance the performance, the communication nodes may be configured to provide a directional mode or an omnidirectional mode. The omnidirectional mode may involve transmitting the signal along the tubular member in two directions. This mode may include using at least one transducer or an array of transducers (e.g., transmitters) to provide the transmission of the signals. The directional mode may involve transmitting the signal in a primary direction. The directional mode may include using an array of transducers to provide the transmission of the signals in a primary direction.

In the various communication coupling devices, the array configuration may include a communication node controller along with one or more ring controllers that are utilized to manage the respective transducers. In certain configurations, the communication node controller may be part of the CPU 204 or circuit board 266. For example, the array configuration may include various transducers that communicate with a communication node controller that manages the transducers and/or has a ring controller that manages each of the respective rings of transducers.

Figure 3:
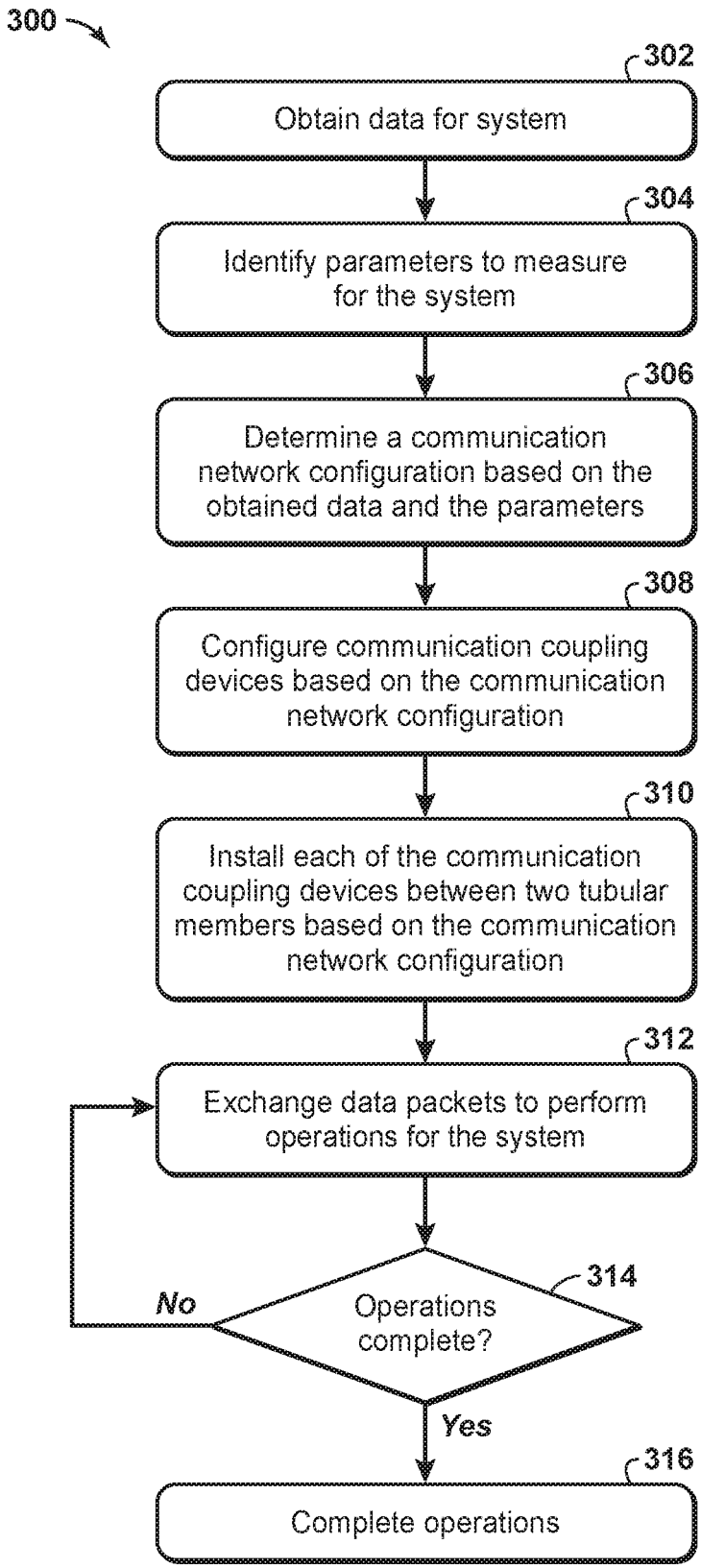
FIG. 3 are exemplary flow charts in accordance with embodiments of the present techniques.

FIG. 3 is an exemplary flow chart 300 in accordance with an embodiment of the present techniques. In FIG. 3, the flow chart 300 is a method for creating, installing and using a wireless communication network, which is utilized during operations of the system. The method may include creating a communication network and installing the communication network, as shown in blocks 302 to 310. Then, the communication network may be utilized during operations, as shown in blocks 312 to 316.

To begin, the method involves creating, configuring and installing the wireless communication network for a system, as shown in blocks 302 to 310. At block 302, data for a system is obtained. The system may include a hydrocarbon system associated with a subsurface region. The well data may include seismic data, vibration data, acoustic data, electromagnetic data, resistivity data, gravity data, well log data, core sample data, and combinations thereof. In other configurations, the well data may include the dimensions and material composition of the tubular members (e.g., the drill strings, production tubing and casing), the material composition of the cement or fluids within the wellbore, length of the tubular members, length of the cement, fluids and/or other information associated with the equipment and/or configuration of the well. Further, the data may also include temperature, pressures, strain, capacitance, conductivity, flow rate, density, and/or other similar properties. The data may be obtained from memory, predicted from a model or simulation of the system and/or determined from equipment associated with the system. At block 304, parameters are identified to measure for the system. The parameters may include temperature, pressures, strain, capacitance, conductivity, flow rate, density, and/or other similar properties, which may be measured by one or more sensors in the communication coupling device. Then, at block 306, a communication network is created based on the obtained data. The creation of the communication network may include settings such as selecting acoustic frequency bands; selecting individual frequencies; optimizing the acoustic communication band for each pair of communication nodes; determining coding method for the communication network and/or determining selective modes for the communication network. In addition, the creation of the communication network may include determining the noises and associated filters to be used for the communications, determining the directional mode settings for the communication nodes, and determining omnidirectional mode settings for the communication nodes. Further, the communication network may be configured to utilize different network types, such as a physical network and/or a wireless network. For example, communication nodes within the communication coupling device may be configured to operate with different wireless network types, such as low frequency, high frequency and/or radio frequency. Further, communication nodes within the communication coupling device may be configured to communicate within the communication coupling device by a hard wire and/or physical connections. Each of these different network types may be used to exchange data packets or signals between different communication nodes, which may directional communication or omnidirectional communications to enhance the hydrocarbon operations. The creation of the communication network may include performing a simulation with a configuration of communication nodes, which may include modeling specific frequencies and/or use of certain type of communication node within specific zones or segments of the wellbore. The simulation may include modeling the drilling strings, the communication of signals between communication nodes and/or other aspects, which may indicate the preferred frequency bands and preferred transmission modes. The simulation results may include the computation of time-varying fluid pressure and fluid compositions and the prediction of signal travel times within the wellbore or within a subsea conduit or pipeline. Performing the simulation may also include modeling fluid, modeling signal transmissions and/or structural changes based on the communication network. Then, the communication coupling device is configured based on the communication network configuration, as shown in block 308. The configuration of the communication coupling device may include configuring the communication nodes to utilize specific communication settings, such as selecting acoustic frequency bands; selecting individual frequencies; optimizing the acoustic communication band for each pair of communication nodes; determining coding method for the communication network, determining selective modes for the communication network, and/or specific transmission modes (e.g., directional or omnidirectional mode), to enhance the exchange of data (e.g., operational data within the wellbore). The configuration of the communication coupling device may include configuring one or more sensors to detect specific properties, such as temperature, pressures, strain, capacitance, conductivity, flow rate, density, and/or other similar properties. Then, at block 310, each of the communication coupling devices is installed between two tubular members based on the communication network configuration. The installation of the communication coupling devices may include disposing one of the communication coupling devices between two tubular members and disposing communication coupling devices and tubular members to the system (e.g., into the wellbore). By way of example, installation may include passing one or more tubular member into a wellbore, securing the communication coupling device to existing tubular members, then securing one or more tubular members to the communication coupling device and the existing tubular members, disposing one or more tubular members, the communication coupling device and the existing tubular members within the wellbore, and repeating the process until the various communication coupling devices and tubular members are installed into the wellbore to form the communication network within the wellbore.

Then, the communication network may be utilized for operations, as shown in blocks 310 to 316. At block 310, data packets are exchanged to perform operations for the system. The exchange of data packets may be used to perform operations on the system, which may be performed concurrently or simultaneously with the operations. The operations may include drilling an exploratory well, a production well, an injection well and/or any combination thereof. The operations may include monitoring a bottomhole assembly, monitoring the tubular members, adjusting the performance of the bottomhole assembly, and/or adjusting the direction of the drill bit. Further, the communications may include exchanging information about the drill bit, associated formation and/or other drilling equipment (e.g., drilling motors, drill string, and/or other equipment in the bottomhole assembly). The operations may include hydrocarbon exploration operations, hydrocarbon development operations, collection of wellbore data, and/or hydrocarbon production operations. For example, the communication network may be used to estimate well performance prediction. As another example, the communication network may be used to adjust hydrocarbon production operations, such as installing or modifying a well or completion, modifying or adjusting drilling operations and/or installing or modifying a production facility. Further, the results may be utilized to predict hydrocarbon accumulation within the subsurface region; to provide an estimated recovery factor; adjust perforation operations and/or to determine rates of fluid flow for a subsurface region. The production facility may include one or more units to process and manage the flow of production fluids, such as hydrocarbons and/or water, from the formation.

Then, at block 314, a determination is made whether the operations are complete. If the operations are not complete, the communication network is used to continue to perform exchanging data to continue performing operations, as shown in block 312. If the operations are complete, the operations may be completed, as shown in block 316. The completion of the operations may involve shutting down operations, and/or removing the tubular members along with the communication coupling devices from the system (e.g., from wellbore).

Beneficially, the method provides an enhancement in the production, development, and/or exploration of hydrocarbons. In particular, the method may be utilized to enhance communication within the system (e.g., wellbore) by providing a specific configuration that optimizes communication. Further, the enhanced communications may involve less computational effort, may involve less interactive intervention, and/or may be performed in a computationally efficient manner. As a result, this may provide enhancements to production at lower costs and lower risk.

As may be appreciated, the blocks of FIG. 3 may be omitted, repeated, performed in a different order, or augmented with additional steps not shown. Some steps may be performed sequentially, while others may be executed simultaneously or concurrently in parallel. For example, in certain embodiments, the transmission modes may be determined and the communication nodes may be configured to utilize different transmission modes. The determination of the transmission node may be based on the operations being performed, such that the transmission mode (e.g., such as directional mode and/or omnidirectional mode) used by the communication node may be based on the operations being performed. Also, in other configurations, the filters may be determined to lessen the background noise from operations, which may then be installed into the communication nodes for use during drilling operations. Also, the method may include determining a filter for each of the operations to be performed. Then, each of the communication nodes may be configured to adjust the filter in the respective communication nodes based on the operations being performed. As a result, a specific filter may be used for the respective communication node based on the operations being performed.

FIGS. 4A, 4B, 4C, 4D, 4E and 4F are exemplary diagrams of an exemplary view of a communication coupling device housing one or more communication nodes in accordance with embodiments of the present techniques. In the diagrams 400, 410, 420, 430, 440 and 450, various communication coupling devices are shown along different views. The transducer may be piezoelectric transducers or electro-magnetic acoustic transducers.

Figure 4A:
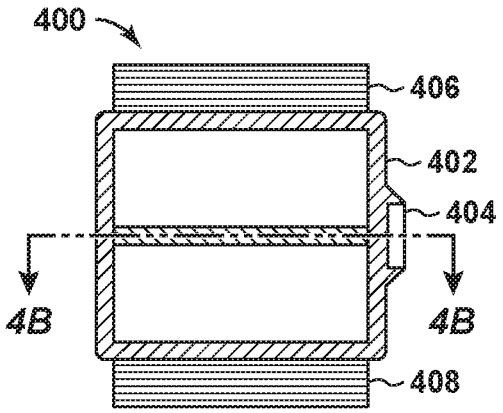
FIGS. 4A, 4B, 4C, 4D, 4E and 4F are exemplary diagrams of an exemplary view of communication coupling devices that house one or more communication nodes in accordance with embodiments of the present techniques.
Figure 4B:
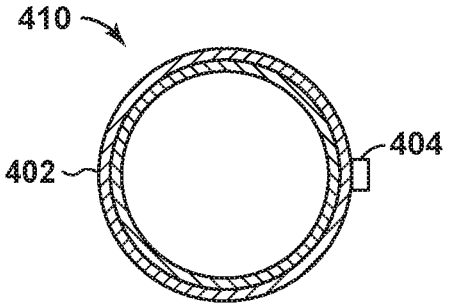

FIGS. 4A and 4B are exemplary diagrams 400 and 410 of an exemplary communication coupling device that includes a body 402 that include a housing 404 to include a communication node and/or a sensor. In the diagram 400, the body 402 may include a first coupling section 406 and a second coupling section 408. The coupling sections 406 and 408 may include threads that are configured to interact and form a coupling with tubular members. In diagram 410, a view of the communication coupling device from FIG. 4A is shown along the line 4B-4B.

Figure 4C:
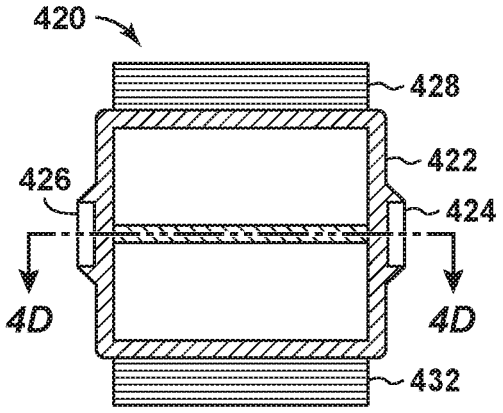
Figure 4D:
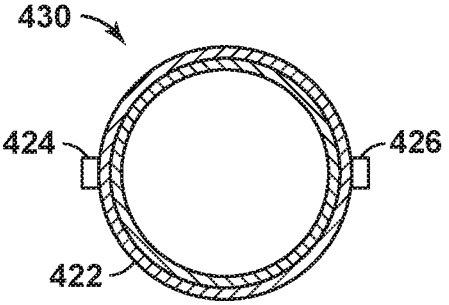

FIGS. 4C and 4D are exemplary diagrams 420 and 430 of an exemplary communication coupling device that includes a body 422 that include a first housing 424 to include a communication node and/or a sensor and a second housing 426 to include a communication node and/or a sensor. In the diagram 420, the body 422 may include a first coupling section 428 and a second coupling section 432. The coupling sections 428 and 432 may include threads that are configured to interact and form a coupling with tubular members. In diagram 430, a view of the communication coupling device from FIG. 4C is shown along the line 4D-4D.

Figure 4E:
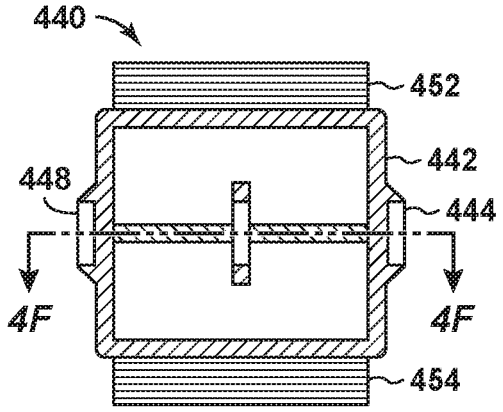
Figure 4F:
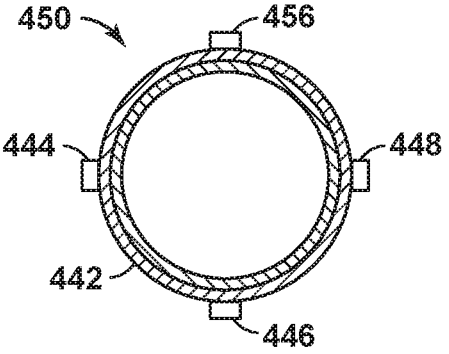

FIGS. 4E and 4F are exemplary diagrams 440 and 450 of an exemplary communication coupling device that includes a body 442 that include a first housing 444 to include a communication node and/or a sensor; a second housing 446 to include a communication node and/or a sensor; a third housing 448 to include a communication node and/or a sensor and a fourth housing 456 to include a communication node and/or a sensor. In the diagram 440, the body 442 may include a first coupling section 452 and a second coupling section 454. The coupling sections 452 and 454 may include threads that are configured to interact and form a coupling with tubular members. In diagram 450, a view of the communication coupling device from FIG. 4F is shown along the line 4F-4F.

In yet other configurations, the physical implementation of the communication coupling device may be formed into an interior region, which may be formed to include one or more communication nodes and/or one or more sensors. By way of example, the internal region may include transducers and their electronic control circuits, and power batteries. The transducers may be used as signal transmitters or receivers, depending on their electronic circuit connections. Transducer types may be piezoelectric device or electro-magnetic acoustic transducer.

In certain configurations, the sensing components may include fiber optic modules to provide continuous monitoring data, while other sensors may be used to provide discrete monitoring data. The communication nodes may include two or more sensing components, which may include two or more types of properties.

Figure 5:
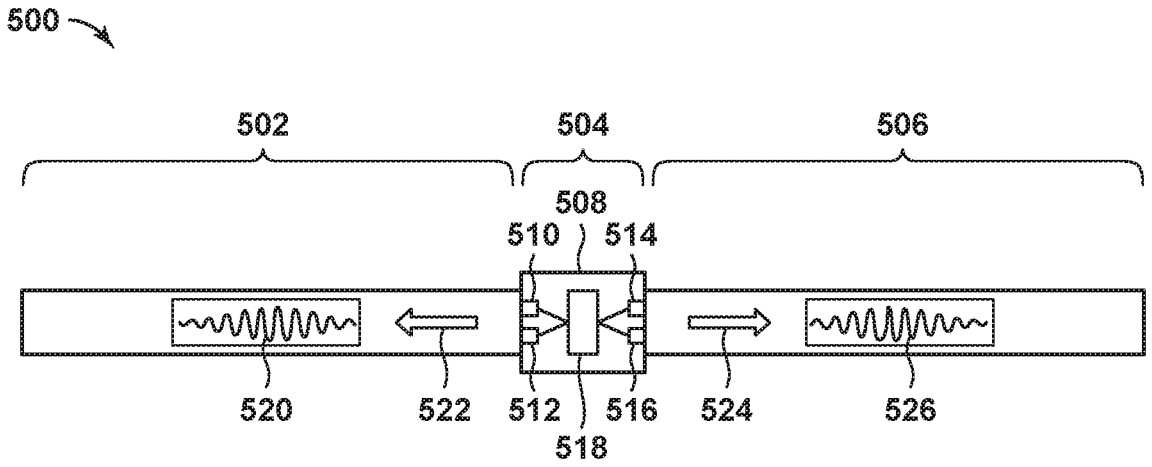
FIG. 5 is a diagram of an exemplary view of a communication coupling device housing one or more communication nodes in accordance with embodiments of the present techniques.

FIG. 5 is a diagram of an exemplary view of a communication coupling device housing one or more communication nodes in accordance with embodiments of the present techniques. In the diagram 500, the communication coupling device is shown having communication nodes and/or transmitters and receivers, which may be referred to as transducers, disposed near each of the ends of the communication coupling device. The transducers may be piezoelectric transducers or electro-magnetic acoustic transducers.

In the diagram 500, the communication coupling device 504 may be disposed between tubular members 502 and 506, which may be pipe joints. The communication coupling device 504 may have a body 508 along with a first coupling section for coupling to the tubular member and a second coupling section for coupling to the pipe joint 506. The body 508 may include a first transducer 510 and a second transducer 512, which is disposed adjacent to the tubular member 502, and a third transducer 514 and a fourth transducer 516, which is disposed adjacent to the tubular member 506. The body 508 may also include a control node 518, which includes communication node electronics. By way of example, the first transducer 510 may be a transmitting transducer, which is configured to transmit a signal 520 along the tubular member 502, as shown along the arrow 522, and a second transducer 512, which is configured to receive a signal along the tubular member 502. By way of example, the third transducer 514 may be a transmitting transducer, which is configured to transmit a signal 526 along the tubular member 506, as shown along the arrow 524, and a fourth transducer 516, which is configured to receive a signal along the tubular member 506.

By disposing the transducers near the ends of the communication coupling device 504, the acoustic signal may be transmitted and received in a more efficient manner. A primary benefit of the configuration is the ability to have transducers at both ends to communicate directly into each connected joint. The configuration lessens the signal attenuation, signal loss and degrading the signal form by passing through the communication coupling device 504, which is a challenge to signal propagation along the tubular member. By having transducers at each end of the communication coupling device 504, the signal is received at one end and the communication coupling device 504 generates a new acoustic signal at the other end, which eliminates the need for the acoustic signal to cross the communication coupling device 504. Accordingly, the communication coupling device 504 provides a mechanism that provides for generation of a clean signal on each joint and eliminates need for acoustic signal to cross communication coupling device 504. Thus, the present techniques may enhance range, signal strength, error rate, energy efficiency, and system reliability.

In yet other configurations, this configuration may include various enhancements. In an enhancement, signals may be transmitted along the communication coupling device to provide data on various properties. For example, the communication coupling device may include sensing configurations, such as transmitting signals acoustically across the communication coupling device and then generate similar signals via the communication node at the communication coupling device. Then, the two respective signals may be evaluated to determine the properties (e.g., determining a difference between the signals). The properties may be used to determine information about cement quality, pipe contents, and the like.

In yet another configuration, the configuration may include different array configurations in the communication coupling device, which may be similar to FIGS. 4A to 4F. The exemplary communication coupling device that includes a housing that includes the transmitter and receiver transducers and/or a transducer that may operate as a receiver and transceiver. The array configuration may include two receiver transducers and/or two transmitter transducers at each of the ends of the communication coupling device. In yet another configuration, the array configuration may include three receiver transducers and/or three transmitter transducers at each of the ends of the communication coupling device, while another array configuration may include four receiver transducers and/or four transmitter transducers at each of the ends of the communication coupling device.

In other configurations, the communication coupling device may include different transducers to provide various enhancements. For example, the communication coupling device may include a single transducer configured to receive acoustic signals at each end of the communication coupling device and to transmit acoustic signals at each end of the communication coupling device. In other configurations, two or more transducers may be configured to operate at different frequencies. For example, a first transducer may be configured to receive acoustic signals at each end of the communication coupling device, a second transducer may be configured to transmit acoustic signals at each end of the communication coupling device and a third transducer that is configured to transmit acoustic signals at a different frequency from the first transducer at each end of the communication coupling device. The third transducer may be configured to operate at a lower frequency.

In yet other configurations, the communication coupling device may include different arrays of transducers disposed at each end of the communication coupling device. The communication coupling device may be configured to provide constructive interference to increase signal passing through the communication coupling device, which may use less energy expenditure. The communication coupling device may be configured to provide destructive interference to reduce the signal passing through the communication coupling device. The communication coupling device may be configured to provide functionality of destructive interference and/or constructive interference by transducers at the respective ends of the communication coupling device. The configuration may include two or more transmission transducers at the respective ends of the communication coupling device, which may include two transmission transducers directed at different primary directions.

The present techniques include a configuration that may utilize communication coupling device that include one or more communication nodes, which may be one or more low-frequency communication nodes and/or one or more high-frequency communication nodes. These different communication nodes may be utilized to provide enhancements to the operations. By way of example, certain communication coupling devices may include one or more communication nodes, but may not include sensors (e.g., without sensors), which may involve disposing communication nodes for locations that do not need to be monitored or involve sensing. The communication nodes may involve using low-frequency communication nodes for long range telemetry, which may be utilized for optimal performance with low system complexity. Further, the communication coupling device may include one or more communication nodes along with one or more sensors, which may involve disposing communication nodes for locations that do need to be monitored or involve sensing. The communication nodes may involve using high-frequency communication nodes to be used in locations that involve sensing and/or may include monitoring. The high-frequency communication nodes may involve a higher frequency ranges as compared to a low frequency ranges.

In other configurations, the communication nodes may include other enhancements. For example, the communication nodes may be configured to utilize a different effective clock speeds (e.g., a low-frequency effective clock speed) to monitor for received signals and to wake the communication node from a sleep mode that utilizes the another effective clock speed (e.g., high-frequency effective clock speed); may be configured to communicate with low-frequency effective clock speeds to be able to communicate with other low-frequency devices, which may operate at frequencies above the noise; may be configured to provide redundant communications; may be configured to adjust or modify the alias frequency and/or may be configured to avoid downhole noise by utilizing aliasing with high pass filter.

In addition, other configurations may include processors that include different types of transducers, for example, piezoelectric components or magnetostrictive components, to generate the signals and/or to receive the signals. By way of example, the communication nodes may include piezoelectric transducers of different sizes. The encoding components may include smaller piezoelectric transducers that may be configured to transmit higher frequency signals (e.g., around their resonant frequency bands), which may also use less electrical power as compared to larger piezoelectric transducer or to transmit signals outside the resonant frequency bands of a given transducer. In addition, the smaller piezoelectric transducers may provide a mechanism to lessen the size of the structure for the communication nodes. Accordingly, the encoding component may be configured to transmit at higher frequencies, which utilizes less energy than the low-frequency transmissions. Thus, by using the high-frequencies for the transmissions in combination with the low-frequency clock speeds on the decoding component (e.g., receiver), the communication nodes may lessen energy usage.

In other configurations, aliased signals (e.g., aliased frequencies) may be used to enhance redundancy. In particular, the transmitted signals may be generated by at two or more frequency bands, which correspond to the same aliased frequencies at the receiving end (e.g., receiving communication node). For example, if frequencies in a first frequency band are unworkable in the downhole environment, the communication nodes may alternately transmit signals on a second frequency band because both frequency bands alias to the same aliased frequencies (e.g., the mapping is to a similar detectable frequency once normalized to a low-frequency clock). Accordingly, several alternate frequency bands may be available based on the differences of the clock speeds. As a result, several aliased frequencies may be used to mitigate the risk of losing communication due to an unworkable frequency band (e.g., downhole environment or wellbore conditions, such as caused by frequency selective fading). By way of example, several aliased frequencies may be used to communicate instructions to the bottomhole assembly to manage the operations.

In one or more configurations, filters may be used to further manage the exchange of data packets (e.g., operational data) between the communication nodes. The communication nodes may include filters configured remove production noises and/or noises from operations, where typical low frequency exists (e.g. less than (<) about 10 kHz to about 15 kHz). By way of example, the communication nodes may include a high pass filter configured to pass certain frequencies. Preferably, the filter may be used to remove low-frequency signals. In a preferred configuration, one or more filters may be activated or deactivated in the communication node, which may be communicated adjusted based on signals communicated between the communication nodes. As such, the communication node may be configured to apply a filter to be applied to each received signal when the setting is enabled and to bypass the filter when the setting is disabled. The change in the status of the filtering may be based on a setting in the communication node or based on a notification that is received in a transmitted signal.

In one or more configurations, the communication network may be a wireless communication network that includes different types of wireless communication types. The wireless communication networks may include high-frequency communication networks, which include high-frequency communication nodes, and/or low-frequency communication networks, which include low-frequency communication nodes. By way of example, the present techniques may include a configuration that utilizes different types of communication nodes (e.g., low-frequency communication nodes and/or high-frequency communication nodes) to form the communication network, which may include different types of networks. These different communication nodes may be distributed along one or more tubular members, which may be within a wellbore, along a pipeline, or along a subsea tubular member, to enhance operations. The communication nodes may include using low-frequency communication nodes at locations that do not involve sensing (e.g., in an uncompleted vertical section). The low-frequency communication nodes may involve a low-frequency ranges, which may be utilized for optimal performance with low system complexity. The high-frequency communication nodes may be used for locations that involve sensing (e.g., near completions or zones of interest). The high-frequency communication nodes may involve a higher frequencies as compared to a low-frequencies used by the low-frequency communication nodes.

As a further example, the communication network may include low-frequency communication nodes; high-frequency communication nodes; communication nodes configured to communicate with high-frequencies and low-frequencies signals and communication nodes that are configured to communicate with low and/or high frequency radio frequencies (RF). The low-frequency communication nodes may be configured to transmit signals and to receive signals that are less than or equal to (≤) 200 kHz, ≤100 kHz, ≤50 kHz, or ≤20 kHz. In particular, the low-frequency communication nodes may be configured to exchange signals in the range between 100 Hz and 20 kHz; in the range between 1 kHz and 20 kHz; and in the range between 5 kHz and 20 kHz. Other configurations may include low-frequency communication nodes, which may be configured to exchange signals in the range between 100 Hz and 200 kHz; in the range between 100 Hz and 100 kHz; in the range between 1 kHz and 200 kHz; in the range between 1 kHz and 100 kHz; in the range between 5 kHz and 100 kHz and in the range between 5 kHz and 200 kHz. The communication nodes may also include high-frequency communication nodes configured to transmit and receive signals that are greater than (>) 20 kHz, >50 kHz, >100 kHz or >200 kHz. Also, the high-frequency communication nodes may be configured to exchange signals in the range between greater than 20 kHz and 1 MHz, in the range between greater than 20 kHz and 750 kHz, in the range between greater than 20 kHz and 500 kHz. Other configurations may include high-frequency communication nodes, which may be configured to exchange signals in the range between greater than 100 kHz and 1 MHz; in the range between greater than 200 kHz and 1 MHz; in the range between greater than 100 kHz and 750 kHz; in the range between greater than 200 kHz and 750 kHz; in the range between greater than 100 kHz and 500 kHz; and in the range between greater than 200 kHz and 500 kHz.

In one or more configurations, the communication network may include a physical connection network. The physical connections may include one or more cables, one or more electrical conductors and/or one or more fiber optic cables, which may be secured to a tubular member and used to evaluate subsurface conditions. The physical connection may be secured to an inner portion of the tubular member and/or an outer portion of the tubular member. The physical connection provides a hard wire connection that may provide concurrent or real-time exchange of data packets along the tubular members. In addition, the physical connection may be used to provide power directly to communication nodes and/or downhole sensors within the communication coupling device. By way of example, the physical connections may be within an array of transducers, which are configured to wireless communicate with other transducers not associated with the array.

In other configurations, as physical cables may be difficult to deploy along tubular members in certain environments (e.g., a wellbore), the communication network may include a combination of one or more wireless networks with one or more physical connection networks. In such a configuration, the physical connection network of communication nodes may be disposed at locations that do not involve sensing (e.g., along certain sections of the tubular members), while the wireless network of communication nodes may be disposed at locations in horizontal sections of the wellbore or sections that involve sensing (e.g., certain sections or specific locations along the drilling string or the bottomhole assembly, which may be near the drill bit). Another configuration may include using wireless network of communication nodes for long range communications, while the wired physical connections network of communication nodes may be used for monitored sections of the wellbore to handle the high speed data transmissions within those sections. By way of example, the communication network may be a mixed network that is configured to have shorter wired sections or wired communication nodes along certain portions of the drilling string. The wireless section of the drilling strings may be near the joints (e.g., at the top or bottom of a section of drilling strings) to minimize the risk of wire breakage from spinning the tubular member (e.g., drilling string).

In yet another configuration, the decoding or detecting modes may utilize windowing, a sliding window, data smoothing, statistical averaging, trend detection, polyhistogram and the like. The detecting mode may also be combined with simple redundancy of various forms of spread spectrum communications, such as spectrum-constrained application. Also, the decoding modes may be combined with one or more layers of forward error correction (FEC). By way of example, the decoding modes may include Fast Fourier Transform (FFT) detection and/or zero crossing detection (ZCX), which decode via frequency domain and time domain, respectively. The tones may be defined as decoded or detected if FFT recognizes the correct frequencies or ZCX recognizes the correct periods. The FFT and/or ZCX may be selected depending on computational power and energy efficiency of the microcontroller deployed in the communication node. For FFT, tone selection may be based on the relative magnitude of each tone. FFT may involve greater computational power, but is more able to handle background noise. For ZCX, tone selection may be based on normalized period of zero crossings of each tone. ZCX may involve less computational power, but may be vulnerable to misdetections due to background noise. Also, FFT may resolve amplitude dependent signals, while ZCX involves low power devices and/or low received signal levels.

In other configurations, other devices (not shown) may be used within the system to communicate with the communication nodes in the communication coupling device. By way of example, the other devices may include hydrophones and/or other tools, which may be disposed inside the wellbore along a wireline and/or the drilling string, casing or tubing. The other tools may be utilized to exchange data (e.g., operational data) with communication nodes in the respective communication coupling device, which may be secured between tubular members. The other devices may be configured to receive signals at low frequencies, such as signals that are less than or equal to (≤) 200 kHz, ≤100 kHz, ≤50 kHz, ≤20 kHz; in the range between 100 Hz and 20 kHz; in the range between 1 kHz and 20 kHz; and in the range between 5 kHz and 20 kHz. These low-frequency devices may be disposed along different sections of the tubular members.

Persons skilled in the technical field will readily recognize that in practical applications of the disclosed methodology, it is partially performed on a computer, typically a suitably programmed digital computer or processor based device. Further, some portions of the detailed descriptions which follow are presented in terms of procedures, steps, logic blocks, processing and other symbolic representations of operations on data bits within a computer memory. These descriptions and representations are the means used by those skilled in the data processing arts to most effectively convey the substance of their work to others skilled in the art. In the present application, a procedure, step, logic block, process, or the like, is conceived to be a self-consistent sequence of steps or instructions leading to a desired result. The steps are those requiring physical manipulations of physical quantities. Usually, although not necessarily, these quantities take the form of electrical or magnetic signals capable of being stored, transferred, combined, compared, and otherwise manipulated in a computer system.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present application, discussions utilizing the terms such as "processing" or "computing", "calculating", "comparing", "determining", "displaying", "copying," "producing," "storing," "adding," "applying," "executing," "maintaining," "updating," "creating," "constructing" "generating" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

Embodiments of the present techniques also relate to an apparatus for performing the operations herein. This apparatus, such as the control unit or the communication nodes, may be specially constructed for the required purposes, or it may comprise a general-purpose computer or processor based device selectively activated or reconfigured by a computer program stored in the computer (e.g., one or more sets of instructions). Such a computer program may be stored in a computer readable medium. A computer-readable medium includes any mechanism for storing or transmitting information in a form readable by a machine (e.g., a computer). For example, but not limited to, a computer-readable (e.g., machine-readable) medium includes a machine (e.g., a computer) readable storage medium (e.g., read only memory ("ROM"), random access memory ("RAM"), magnetic disk storage media, optical storage media, flash memory devices, etc.), and a machine (e.g., computer) readable transmission medium (electrical, optical, acoustical or other form of propagated signals (e.g., carrier waves, infrared signals, digital signals, etc.)).

Furthermore, as will be apparent to one of ordinary skill in the relevant art, the modules, features, attributes, methodologies, and other aspects of the invention can be implemented as software, hardware, firmware or any combination of the three. Of course, wherever a component of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of skill in the art of computer programming. Additionally, the present techniques are in no way limited to implementation in any specific operating system or environment.

The hydrocarbon operations may include utilizing the communication nodes and a control unit. The communication network may include performing serial networking; may include performing parallel processes in different zones along the tubular members; and/or may include performing ultrasonic frequency networks along with one or more radio networks (e.g., at the topside, which may be below grade), along with one or more hydrophone networks; along with wired networks (e.g., which may be wired to a specific depth or within specific regions). The communication nodes may be configured to operate autonomously based on predefined or built-in rules, or implicitly by other communication nodes conveying instructions and may even adjust the instructions during operations.

By way of example, the control unit may include a computer system that may be used to perform any of the methods disclosed herein. A central processing unit (CPU) is coupled to system bus. The CPU may be any general-purpose CPU, although other types of architectures of CPU (or other components of exemplary system) may be used as long as CPU (and other components of system) supports the inventive operations as described herein. The CPU may execute the various logical instructions according to disclosed aspects and methodologies. For example, the CPU may execute machine-level instructions for performing processing according to aspects and methodologies disclosed herein.

The computer system may also include computer components such as a random access memory (RAM), which may be SRAM, DRAM, SDRAM, or the like. The computer system may also include read-only memory (ROM), which may be PROM, EPROM, EEPROM, NOR flash, NAND flash or the like. RAM and ROM hold user and system data and programs, as is known in the art. The computer system may also include an input/output (I/O) adapter, a graphical processing unit (GPU), a communications adapter, a user interface adapter, and a display adapter. The I/O adapter, the user interface adapter, and/or communications adapter may, in certain aspects and techniques, enable a user to interact with computer system to input information.

The I/O adapter preferably connects a storage device(s), such as one or more of hard drive, compact disc (CD) drive, floppy disk drive, tape drive, etc. to computer system. The storage device(s) may be used when RAM is insufficient for the memory requirements associated with storing data for operations of embodiments of the present techniques. The data storage of the computer system may be used for storing information and/or other data used or generated as disclosed herein. The communications adapter may couple the computer system to a network (not shown), which may include the communication network for the wellbore and a separate network to communicate with remote locations), which may enable information to be input to and/or output from system via the network (for example, a wide-area network, a local-area network, a wireless network, any combination of the foregoing). User interface adapter couples user input devices, such as a keyboard, a pointing device, and the like, to computer system. The display adapter is driven by the CPU to control, through a display driver, the display on a display device.

The architecture of system may be varied as desired. For example, any suitable processor-based device may be used, including without limitation personal computers, laptop computers, computer workstations, and multi-processor servers. Moreover, embodiments may be implemented on application specific integrated circuits (ASICs) or very large scale integrated (VLSI) circuits. In fact, persons of ordinary skill in the art may use any number of suitable structures capable of executing logical operations according to the embodiments.

As may be appreciated, the method may be implemented in machine-readable logic, such that a set of instructions or code that, when executed, performs the instructions or operations from memory. By way of example, the communication nodes may include a processor; an encoding component, decoding component and memory. The decoding component is in communication with the processor and is configured to receive operational data associated with drilling operations. The memory is in communication with the processor and the memory has a set of instructions, wherein the set of instructions, when executed, are configured to perform the method steps or configurations, as noted above.

In certain configurations, the present techniques may utilize the periodic relationship between aliased frequencies and signal frequencies to decode signal information. By limiting the communication frequency band to have the aliasing resulting in a one-to-one relationship between an ultrasonic frequency and an aliased frequency, each aliased frequency determines exactly one ultrasonic frequency. For example, for a first frequency band, the communication node may be configured to decode signal information using a processor operating at a low-frequency effective clock speed, which uses less power as compared to a processor operating at a high-frequency effective clock speed. In particular, a processor may operate at an effective clock speed of 32.768 kHz, which may correspond to a receiver that draws a current of 1 milliamps (mA), while a processor may operate at an effective clock speed of 48 MHz, which may correspond to a receiver that draws current of 15 mA. As such, the processor operating at the low-frequency effective clock speed may significantly lessen the energy used as compared to the processor operating at the high-frequency effective clock speed.

In certain configurations, the present techniques involves various relationships to manage the frequency aliasing within communication network. By way of example, the ratio of the low-frequency effective clock speed to the high-frequency effective clock speed may be greater than 1:2; may be greater than 1:4; may be greater than 1:10; in a range between 1:2 and 1:1000; in a range between 1:4 and 1:100 and/or in a range between 1:10 and 1:80. In other configurations, the Nyquist frequency is associated with the receiving communication node and is based on the effective clock speed in force at the receiving communication node. For example, the transmitted signal frequency may be greater than the Nyquist frequency; may be greater than two times the Nyquist frequency; may be greater than three times the Nyquist frequency; or the transmitted signal frequency may be greater than four times the Nyquist frequency. The ratio of the Nyquist frequency to the transmitted signal frequency may be in the range between 1:2 and 1:1000; may be in a range between 1:2 and 1:100 and/or may be in a range between 1:2 and 1:10. As another example, the transmitted signal, which may be at a frequency higher than the sampling frequency, may be decoded to provide the information for decoding the remainder of the packet.

In one configuration, the communication nodes may be configured to transmit at a high-frequency effective clock speed and may be configured to receive at a low-frequency effective clock speed. In such a configuration, the communication nodes may utilize higher energy in transmitting the data packets and may utilize lower energy in receiving the data packets (e.g., operational data). By way of example, the communication nodes may include one or more processors operating at an effective clock speed of about 48 MHz for transmission of data packets on the communication network and one or more processors operating at an effective clock speed of about 32.768 kHz for reception of data packets. The low-frequency effective clock speeds may include 32 kHz, 32.768 kHz, 38 kHz, 77.500 kHz, 100 kHz, 120 kHz, and 131.072 kHz; and the high-frequency effective clock speeds may include 500 kHz, 1 MHz, 2 MHz, 8 MHz, 32 MHz, 48 MHz and 80 MHz.

In addition, other configurations may include processors that include different types of transducers, for example, piezoelectric components or magnetostrictive components, to generate the signals and/or to receive the signals. By way of example, the communication nodes may include piezoelectric transducers of different sizes. The encoding components may include smaller piezoelectric transducers that may be configured to transmit higher frequency signals (e.g., around their resonant frequency bands), which use less electrical power as compared to larger piezoelectric transducer or to transmit signals outside the resonant frequency bands of a given transducer. In addition, the smaller piezoelectric transducers may provide a mechanism to lessen the size of the structure for the communication nodes. Accordingly, the encoding component may be configured to transmit at higher frequencies, which utilizes less energy than the low-frequency transmissions. Thus, by using the high-frequencies for the transmissions in combination with the low-frequency effective clock speeds on the decoding component (e.g., receiver), the communication nodes may lessen energy usage.

In other configurations, the aliased signals (e.g., aliased frequencies) may be used to enhance redundancy. In particular, the transmitted signals may be generated by at two or more frequencies, which correspond to the same aliased frequencies at the receiving end (e.g., receiving communication node). For example, if frequencies in a first frequency band are unworkable in the downhole environment, the communication nodes may alternately transmit signals on a second frequency band because both bands alias to the same aliased frequencies (e.g., the mapping is to a similar detectable frequency once normalized to a low-frequency effective clock speed). Accordingly, several alternate frequency bands may be available based on the differences of the effective clock speeds. As a result, several aliased frequencies may be used to mitigate the risk of losing communication due to an unworkable frequency band (e.g., downhole environment or wellbore conditions, such as caused by frequency selective fading). Certain configurations may utilize the aliased frequencies to signal the communication node, which may be to perform a specific operation or to transmit data packets (e.g., operational data). By way of example, communication nodes may be configured to use a combination of one or more aliased frequencies as a signal to place the communication node into an operational mode in the respective communication node. In particular, a communication node may use a sequence of one or more aliased frequencies as a signal to change the mode in the communication node.

In yet another configuration, the communication nodes may be configured to operate with low-frequency signals and/or high-frequency signals, which may be used to communication with the communication nodes. The low-frequency device may be utilized to exchange data or instructions to the communication nodes. This configuration may be used to reach or communicate with communication nodes that may provide longer range communications than conventionally utilized within the wellbore. As a specific example, the communication nodes may be configured to receive communication signals from a communication device, such as a hydrophone or a designated communication node, transmitting in a lower frequency band (e.g., to provide longer range communications) without involving reconfiguration of any network devices, such as the communication nodes. In particular, the downhole network may be configured to receive and/or to transmit frequencies less than 200 kHz or less than 150 kHz, but greater than the drilling noises, which are less than 50 kHz. The use of the lower frequencies extends the distance that the lower-frequency communication nodes may be spaced apart from each other and maintain the exchange of data packets. As a specific example, certain communication nodes may be configured to receive signals at frequencies less than 200 kHz. These low-frequency communication nodes may be disposed within different zones of the wellbore, which may be utilized within the respective zones to lessen the risk of becoming separated or losing a portion of the downhole network. The communication nodes that operate at these lower frequencies may be configured to receive longer range signals as compared with communication nodes operating at higher frequencies. As a result, the lower-frequency communication nodes may be reachable, while the higher-frequency communication nodes may not be able to communicate in certain portions of the tubular members.

In one or more configurations, filters may be used to further manage the exchange of data packets (e.g., operational data) between the communication nodes. The communication nodes may include filters configured remove noises and/or other background noises, where typical low frequency exists (e.g. less than about 10 kHz, less than about 15 kHz, less than about 50 kHz or less than about 65 kHz). By way of example, the communication nodes may include a high pass filter configured to pass certain frequencies. Preferably, the filter may be used to remove low-frequency signals. In a preferred configuration, one or more filters may be activated or deactivated in the communication node, which may be communicated adjusted based on signals communicated between the communication nodes and may be based on drilling operations being performed. As such, the communication node may be configured to apply a filter to be applied to each received signal when the setting is enabled and to bypass the filter when the setting is disabled. The change in the status of the filtering may be based on a setting in the communication node or based on a notification that is received in a transmitted signal.

In still yet another configuration, the high-frequency effective clock speed of the communication node may be used with the low-frequency effective clock speed in the same communication node, which may be utilized together to verify signals exchanged between the communication nodes. For example, the communication node may receive a signal and decode the signal with the high-frequency effective clock speed and the low-frequency effective clock speed. Then, the communication node may be configured to compare the decoded information with the different effective clock speeds to determine if the signal is accurate and/or decoded information with the different effective clock speeds to obtain the information indicated or decoding using low frequency effective clock speed first as initial screening to decide to use high frequency effective clock speed or not, if needed, high frequency effective clock speed is used, this way could save energy by avoid using high frequency effective clock speed as much as possible.

As a further example, the communication network may include low-frequency communication nodes; high-frequency communication nodes; communication nodes configured to communicate with high-frequencies and low-frequencies signals and communication nodes that are configured to communicate with low and/or high frequency radio frequencies (RF). The low-frequency communication nodes may be configured to transmit signals and to receive signals that are less than or equal to (≤) 200 kHz, ≤175 kHz, or ≤150 kHz. In particular, the low-frequency communication nodes may be configured to exchange signals in the range between 100 Hz and 200 kHz. Other configurations may include low-frequency communication nodes, which may be configured to exchange signals in the range between 100 Hz and 200 kHz; or in the range between 100 Hz and 150 kHz. The communication nodes may also include high-frequency communication nodes configured to transmit and receive signals that are greater than (>) 200 kHz, >500 kHz, or >750 kHz. Also, the high-frequency communication nodes may be configured to exchange signals in the range between greater than 200 kHz and 1 MHz, in the range between greater than 200 kHz and 750 kHz, in the range between greater than 200 kHz and 500 kHz.

In yet another configuration, the aliasing may utilize different decoding modes. The decoding or detecting modes may utilize windowing, a sliding window, data smoothing, statistical averaging, trend detection, polyhistogram and the like. The detecting mode may also be combined with simple redundancy of various forms of spread spectrum communications, such as spectrum-constrained application. Also, the decoding modes may be combined with one or more layers of forward error correction (FEC). By way of example, the decoding modes may include Fast Fourier Transform (FFT) detection and/or zero crossing detection (ZCX), which decode via frequency domain and time domain, respectively. The tones may be defined as decoded or detected if FFT recognizes the correct frequencies or ZCX recognizes the correct periods. The FFT and/or ZCX may be selected depending on computational power and energy efficiency of the microcontroller deployed in the communication node. For FFT, tone selection may be based on the relative magnitude of each tone. FFT may involve greater computational power, but is more able to handle background noise. For ZCX, tone selection may be based on normalized period of zero crossings of each tone. ZCX may involve less computational power, but may be vulnerable to misdetections due to background noise. Also, FFT may resolve amplitude dependent signals, while ZCX involves low power devices and/or low received signal levels.

It should be understood that the preceding is merely a detailed description of specific embodiments of the invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. As such, it will be apparent, however, to one skilled in the art, that many modifications and variations to the embodiments described herein are possible. All such modifications and variations are intended to be within the scope of the present invention, as defined by the appended claims.

The invention claimed is:

1. A method of communicating data among a plurality of communication nodes for a system, the method comprising:

determining a communication network, wherein the communication network comprises a plurality of communication nodes;

configuring the plurality of communication nodes, wherein each of the plurality of communication nodes is configured to transmit signals between two or more of the plurality of communication nodes along a plurality of tubular members;

providing a plurality of communication coupling devices, wherein each of the plurality of communication coupling devices is configured to enclose one or more of the communication nodes from the plurality of communication nodes within an interior region of the communication coupling device;

wherein each of the plurality of communication nodes comprises a first array of transducers and a second array of transducers;

wherein the first array of transducers is disposed on a first end of the communication coupling device, and wherein the second array of transducers is disposed on a second end of the communication coupling device, the first array of transducers comprising at least one transducer configured to transmit data packets away from the communication coupling device, to others of the plurality of communication coupling devices, at the first end, and at least one transducer configured to receive data packets from others of the plurality of communication coupling devices, the second array of transducers comprising at least one transducer configured to transmit data packets away from the communication coupling device, to others of the plurality of communication coupling devices, at the second end, and at least one transducer configured to receive data packets from others of the plurality of communication coupling devices;

installing each of the plurality of communication coupling devices between two tubular members of the plurality of tubular members in the system and wherein the first array of transducers is disposed adjacent to one of the two tubular members and the second array of transducers is disposed adjacent to other of the two tubular members;

communicating operational data between two or more of the plurality of communication nodes during operations for the system; and performing operations based on the operational data; and wherein the communication coupling devices generate new, clean signals and said signals do not cross the communication coupling devices.

2. The method of claim 1, wherein installing each of the plurality of communication coupling devices between two tubular members of the plurality of tubular members further comprises:

mechanically coupling the communication coupling device to a first tubular member of the plurality of tubular members; and mechanically coupling the communication coupling device to a second tubular member of the plurality of tubular members.

3. The method of claim 1, further comprising:

identifying parameters to measure in the system;

wherein one or more of the plurality of communication coupling devices is configured to enclose one or more sensors within the interior region, wherein each of the one or more sensors is configured to measure a parameter associated with the system;

wherein at least one of the one or more sensors is configured to obtain measurements internally within the plurality of tubular members or externally from the tubular members; and wherein the parameter associated with the system comprises one or more of pressure, temperature, flow rate, sound, vibrations, resistivity, impedance, capacitance, infrared, gamma ray, and any combination thereof.

4. The method of claim 1, wherein each of the plurality of communication nodes is configured to transmit signals between two or more of the plurality of communication nodes in an omnidirectional mode or a directional mode; and wherein the transmission of the operational data is performed in a directional mode or in an omnidirectional mode.

5. The method of claim 1, wherein each of the plurality of communication nodes comprises one or more transducers.

6. The method of claim 1, wherein the transducers in the first array of transducers are circumferentially spaced apart about a perimeter of at least one of the plurality of communication coupling devices, and wherein the transducers in the second array of transducers are circumferentially spaced apart about the perimeter of at least one of the plurality of communication coupling devices.

7. The method of claim 1, wherein the transducers in the first array of transducers are equidistantly spaced apart about a perimeter of one of the plurality of communication coupling devices, and wherein the transducers in the second array of transducers are equidistantly spaced apart about the perimeter of one of the plurality of communication coupling devices.

8. The method of claim 1, wherein the first array of transducers is configured to generate one or more signals to provide constructive interference to one or more signals received at the second end.

9. The method of claim 1, wherein the first array of transducers and the second array of transducers are configured to exchange acoustic signals with other communication nodes of the plurality of communication nodes, and are configured to exchange signals between the first array of transducers and the second array of transducers via a physical connection.

10. The method of claim 1, wherein the each of the plurality of communication nodes receive one or more signals in one of the plurality of communication nodes, and filter the one or more signals using a high pass filter to lessen background noise from the one or more signals in the one of the plurality of communication nodes.

11. The method of claim 1, wherein the communicating operational data between two or more of the plurality of communication nodes during the operations for the system further comprises transmitting the operational data through a portion of the plurality of the tubular members between the two or more of the plurality of communication nodes, or a portion of the fluid adjacent to the plurality of the tubular members between the two or more of the plurality of communication nodes.

12. The method of claim 1, wherein the communicating between the plurality of communication nodes comprises exchanging high-frequency signals that are greater than 20 kilohertz.

13. The method of claim 1, wherein the communicating between the plurality of communication nodes comprises exchanging high-frequency signals that are in a range between 100 kilohertz and 500 kilohertz.

14. The method of claim 1, wherein the operations comprise hydrocarbon operations.

15. The method of claim 1, wherein each of the plurality of communication nodes are configured to transmit signals between two or more of the plurality of communication nodes in an omnidirectional mode.

16. The method of claim 1, wherein the configuration of the first array of transducers and the second array of transducers disposed on the communication coupling devices avoids a loss of acoustic energy of up to 90%.

17. The method of claim 1, wherein each of the tubular members comprise a fluid conduit and the communication coupling devices define part of and are integrated into the fluid conduit.

18. A system for communicating along a plurality of tubular members for a system comprising:

a plurality of tubular members associated with a system;

a communication network associated with the system, wherein the communication network comprises a plurality of communication nodes that are configured to communicate operational data between two or more of the plurality of communication nodes during operations; and a plurality of communication coupling devices, wherein each of the plurality of communication coupling devices is configured to enclose one or more of the communication nodes from the plurality of communication nodes within an interior region of the communication coupling device and each of the plurality of communication coupling devices is secured between two of the plurality of tubular members;

wherein each of the plurality of communication nodes comprises a first array of transducers and a second array of transducers;

wherein the first array of transducers is disposed on a first end of the communication coupling device, and wherein the second array of transducers is disposed on a second end of the communication coupling device, the first array of transducers comprising at least one transducer configured to transmit data packets away from the communication coupling device, to others of the plurality of communication coupling devices, at the first end, and at least one transducer configured to receive data packets from others of the plurality of communication coupling devices, the second array of transducers comprising at least one transducer configured to transmit data packets away from the communication coupling device, to others of the plurality of communication coupling devices, at the second end, and at least one transducer configured to receive data packets from others of the plurality of communication coupling devices;

wherein the first array of transducers is disposed adjacent to one of the two tubular members and the second array of transducers is disposed adjacent to other of the two tubular members; and wherein the communication coupling devices generate new, clean signals and said signals do not cross the communication coupling devices.

19. The system of claim 18, wherein one or more of the plurality of communication coupling devices is configured to enclose at least one sensor within the interior region, wherein each of the at least one sensor is configured to measure a parameter associated with the system, and wherein the at least one sensor is configured to obtain measurements internally within the plurality of tubular members or externally from the tubular members, the measurements comprising one or more of pressure, temperature, flow rate, sound, vibration, resistivity, impedance, capacitance, infrared, gamma ray, and any combination thereof.

20. The system of claim 18, wherein each of the plurality of communication nodes is configured to transmit signals between two or more of the plurality of communication nodes in an omnidirectional mode or a directional mode; and wherein the transmission of the operational data is performed in a directional mode or in an omnidirectional mode.

21. The system of claim 18, wherein each of the plurality of communication nodes comprises one or more transducers.

22. The system of claim 18, wherein the transducers in the first array of transducers are circumferentially spaced apart about a perimeter of at least one of the plurality of communication coupling devices, and wherein the transducers in the second array of transducers are circumferentially spaced apart about the perimeter of at least one of the plurality of communication coupling devices.

23. The system of claim 18, wherein the transducers in the first array of transducers are equidistantly spaced apart about a perimeter of one of the plurality of communication coupling devices, and wherein the transducers in the second array of transducers are equidistantly spaced apart about the perimeter of one of the plurality of communication coupling devices.

24. The system of claim 18, wherein the first array of transducers is configured to generate one or more signals to provide constructive interference to one or more signals received at the second end.

25. The system of claim 18, wherein the first array of transducers and the second array of transducers are configured to exchange acoustic signals with other communication nodes of the plurality of communication nodes, and are configured to exchange signals between the first array of transducers and the second array of transducers via a physical connection.

26. The system of claim 18, wherein the each of the plurality of communication nodes is configured to:

receive one or more signals in one of the plurality of communication nodes; and filter the one or more signals using a high pass filter to lessen background noise from the one or more signals in the one of the plurality of communication nodes.

27. The system of claim 18, wherein the each of the plurality of communication nodes is configured to exchange high-frequency signals that are greater than 20 kilohertz.

28. The system of claim 18, wherein the each of the plurality of communication nodes is configured to exchange high-frequency signals that are in a range between 100 kilohertz and 500 kilohertz.

29. The system of claim 18, wherein each of the plurality of communication nodes are configured to transmit signals between two or more of the plurality of communication nodes in an omnidirectional mode.

30. The system of claim 18, wherein the configuration of the first array of transducers and the second array of transducers disposed on the communication coupling devices avoids a loss of acoustic energy of up to 90%.

31. The system of claim 18, wherein each of the tubular members comprise a fluid conduit and the communication coupling devices define part of and are integrated into the fluid conduit.

* * * * *